US006209302B1

(12) United States Patent
Wortmann et al.

(10) Patent No.: US 6,209,302 B1
(45) Date of Patent: Apr. 3, 2001

(54) FALSE TWIST TEXTURIZING MACHINE

(75) Inventors: Thomas Wortmann, Wuppertal; Dietrich Berges, Marienheide; Hellmut Lorenz; Johannes Bruske, both of Remscheid, all of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/155,621

(22) PCT Filed: Feb. 3, 1998

(86) PCT No.: PCT/EP98/00573

§ 371 Date: Apr. 5, 1999

§ 102(e) Date: Apr. 5, 1999

(87) PCT Pub. No.: WO98/33963

PCT Pub. Date: Aug. 6, 1998

(30) Foreign Application Priority Data

| | | |
|---|---|---|
| Feb. 4, 1997 | (DE) | 197 04 060 |
| Feb. 15, 1997 | (DE) | 197 05 812 |
| Feb. 15, 1997 | (DE) | 197 26 681 |
| Jun. 24, 1997 | (DE) | 197 27 011 |

(51) Int. Cl.[7] ..... D01H 7/46
(52) U.S. Cl. ..... 57/290; 57/280
(58) Field of Search ..... 57/280, 281, 282, 57/283, 284, 290, 291, 288

(56) References Cited

U.S. PATENT DOCUMENTS

| | | | | |
|---|---|---|---|---|
| Re. 30,159 | | 11/1979 | Kubler . | |
| 3,645,081 | | 2/1972 | Salama . | |
| 3,772,869 | | 11/1973 | Mutschler et al. . | |
| 4,051,650 | * | 10/1977 | Gleyze et al. | 57/280 |
| 4,332,132 | * | 6/1982 | Bru et al. | 57/280 |
| 4,581,883 | * | 4/1986 | Streppel | 57/290 |
| 4,773,206 | * | 9/1988 | Kojima et al. | 57/288 |
| 4,809,494 | * | 3/1989 | Dammann | 57/291 |
| 4,905,468 | * | 3/1990 | Tanae et al. | 57/291 |
| 4,993,219 | * | 2/1991 | Maeda et al. | 57/291 |
| 5,148,666 | | 9/1992 | Bauer et al. . | |
| 5,431,002 | | 7/1995 | Treptow . | |
| 5,644,908 | | 7/1997 | Schippers et al. . | |
| 5,794,429 | | 8/1998 | Overstrass et al. . | |
| 5,802,832 | * | 9/1998 | Foster | 57/290 |

FOREIGN PATENT DOCUMENTS

| | | |
|---|---|---|
| 594756 | 1/1978 | (CH) . |
| 24 26 276 | 12/1975 | (DE) . |
| 25 30 125 | 2/1977 | (DE) . |
| 33 24 243 | 2/1984 | (DE) . |
| 36 23 370 | 1/1987 | (DE) . |
| 196 52 620 | 6/1997 | (DE) . |
| 0 412 429 | 2/1991 | (EP) . |
| 0 460 799 | 12/1991 | (EP) . |
| 0 638 675 | 2/1995 | (EP) . |
| 0 641 877 | 3/1995 | (EP) . |
| 0 744 480 | 11/1996 | (EP) . |
| 0 595 086 | 1/1997 | (EP) . |
| 0 763 612 | 3/1997 | (EP) . |

* cited by examiner

*Primary Examiner*—John J. Calvert
*Assistant Examiner*—Gary L. Welch
(74) *Attorney, Agent, or Firm*—Alston & Bird LLP

(57) ABSTRACT

The invention relates to a false twist texturing machine and to a method of texturing synthetic yarns in, in each case, one processing point, in which a twist-stopping device, a heating device, a cooling device and a false twisting unit are disposed inside a false twisting zone. The yarn is withdrawn from the false twisting zone by means of a delivery mechanism. According to the invention, the twist-stopping device takes the form of a rotatable transport roller, around which the yarn is at least partially wrapped in a peripheral direction and which is drivable by a drive in such a way that the yarn is braked or delivered, so that the yarn tensile force is adjustable inside the false twisting zone.

41 Claims, 13 Drawing Sheets

FALSE TWIST TEXTURIZING MACHINE

BACKGROUND OF THE INVENTION

The present invention relates to a yarn false twist texturing machine used in the production of synthetic yarn. Such machines typically comprise a plurality of side-by-side processing points (also referred to as stations)—usually up to 216.

False twist texturing machines of said type comprise a plurality of processing points—usually up to 216 processing points—which are arranged adjacent to one another along the length of the machine. Each of said processing points comprises a first delivery mechanism and a second delivery mechanism. The first delivery mechanism withdraws the yarn from a supply bobbin and delivers it into a false twisting zone. The second delivery mechanism draws the yarn out of the false twisting zone and delivers it to a take-up device, the yarn speed and the stretching of the yarn being determined by the speed ratio between the second and first delivery mechanism.

When texturing synthetic yarns, yarn speeds are customary which demand both a suitably long heating zone and a suitably long cooling zone. In the false twisting process, the quality of the achieved crimping is influenced particularly by the yarn tensile force prevailing in the individual regions inside the false twisting zone. Thus, for example, it is known that a low yarn tensile force not yet jeopardizing the stable yarn course is required in the heating zone for achieving good crimping. On the other hand, it has also been observed that increasing the yarn tensile force, say, in the region of the cooling rail produces improved results. It would therefore be desirable to adjust a yarn tensile force in the false twisting zone which leads to good results both during the heat treatment and during cooling.

From EP 0 638 675 a false twist texturing machine is known which comprises a twist-stopping device in the form of a rotatable transport roller inside the false twisting zone.

Although this does achieve the effect that the friction force exerted by the twist-stopping device upon the yarn leads only to a slight variation of the yarn tensile force, the absolute value of the yarn tensile force in the false twisting zone is substantially dependent upon the draw ratio adjusted between the first and second delivery mechanisms. Thus, a variation of the yarn tensile force in the false twisting zone would be achievable only by varying the yarn speed.

An object of the invention is accordingly to provide possible ways of influencing or controlling the yarn tensile force prevailing in the false twisting zone substantially independently of the yarn speed.

A further object of the invention is to achieve a piecing facility which is particularly protective of the yarn, gentle yarn processing and hence higher texturing speeds. It is likewise an object of the invention to provide a false twist texturing machine, in which each processing point is easily controllable independently of the adjacent processing points.

SUMMARY OF THE INVENTION

The above and other objects and advantages of the present invention are achieved by the provision of a yarn false twisting apparatus and method which comprises a false twisting zone composed of an elongate yarn heater, an elongate cooling plate, a false twist unit, and a yarn feed system for advancing the yarn through the false twist zone. A twist stopping device is positioned upstream of the yarn heater for stopping the twist which runs back in the yarn from the false twist unit. The twist stopping device comprises a rotatable transport roller about which the yarn is at least partially wrapped, and a drive for controlling the rotation of the roller so that the yarn may be braked or advanced thereby.

The false twist texturing machine according to the invention and the texturing method according to the invention are notable in particular for the fact that the yarn tensile force inside the false twisting zone is variable independently of the draw ratio adjusted between the take-off delivery mechanism and the delivery mechanism disposed downstream of the false twisting zone. In such case, the false twist generated in the yarn runs back to the extent necessary for producing the crimping in the yarn. The twist-stopping device is therefore disposed immediately upstream of the heating device. The yarn tensile force in the yarn is influenced by the friction ratios between the running yarn and the peripheral surface of the driven transport roller. The transport roller may, in said case, be driven in such a way that the peripheral speed of the transport roller is lower than the yarn speed. The yarn would therefore be conveyed with a sliding friction component over the peripheral surface of the transport roller. An increase of the yarn tensile force is thereby achieved in the false twisting zone.

For the eventuality that the peripheral speed of the transport roller is equal to the yarn speed, a deflection of the yarn which is substantially neutral in terms of the yarn tensile force is effected by the twist-stopping device. In the false twisting zone the yarn tensile force is effective which results from the speed ratio adjusted between the take-off delivery mechanism and the second delivery mechanism.

In order to produce a low level of yarn tensile force in the false twisting zone, it is necessary to drive the transport roller in such a way that the peripheral speed of the peripheral surface is greater than the yarn speed. The result is a slip between the yarn and the peripheral surface of the transport roller, leading to a reduction in the yarn tension. Said method variant would also be suitable for producing a preliminary stretching in the yarn between the take-off delivery mechanism and the twist-stopping device.

To enable the twist torque of the yarn to be absorbed, a corresponding counter-torque has to be generated by the twist-stopping device. This is achieved in a particularly advantageous manner in that the yarn in the wrap region of the transport roller is conveyed in a zigzag manner on the peripheral surface of the transport roller. At each deflection point this produces between the yarn and the transport roller a friction which counteracts substantially only the transverse forces of the yarn.

The zigzag yarn running track on the peripheral surface of the transport roller may be realized in a particularly advantageous manner by means of individual yarn guide elements disposed on the periphery of the transport roller. It is thereby possible to realize any desired form of yarn excursion at right angles to the yarn running direction. The maximum excursion of the yarn is then determined by the overlap of opposing guide edges. The number of deflections is determined by the relative spacing of the yarn guide elements.

In a preferred development, the yarn guides take the form of rings which are mounted from both ends onto the driven transport roller carrying them. They may, in said case, between them form the yarn running track or be so shaped that the yarn running track is formed by suitable, laterally attached extensions emanating radially from the ring inner surfaces.

In a further preferred embodiment, the transport roller takes the form of two discs, which at their outer edges have laterally projecting yarn guide elements and are so arranged relative to one another on a drive shaft that a zigzag yarn running track is produced at a peripheral surface formed by the yarn guide elements.

In order to influence the wrap of the yarn around the yarn guide edges of the yarn guide elements, it is particularly advantageous when the yarn guide elements are of an adjustable design. It is therefore possible, given only a slight wrap of the peripheral surface of the transport roller, to produce in the yarn a high friction torque for absorbing the twist torque of the yarn.

The yarn may be pieced in a particularly gentle manner onto the transport roller by a movable yarn deflection device which is disposed directly in the yarn course upstream or downstream of the transport roller in such a way that the angle of wrap at the transport roller is variable by means of the deflection device. In said case, the angle of wrap at the transport roller may be adjusted in the range of between 0 and 360°. The yarn is preferably pieced initially with a very slight wrap onto the transport roller. It is then possible by means of the movement of the yarn deflection device for the wrap at the transport roller to be steadily increased up to the wrap required for delivery or the wrap required for the yarn course.

It has proved particularly advantageous when the yarn guide edges of the yarn guide elements have a radius of curvature of at least 1.5 mm. A yarn-protecting deflection for realizing the zigzag yarn course is thereby guaranteed.

The zigzag described by the yarn running track should, in the present case, comprise an angle of at least 100° which is open towards one or the other end of the transport roller.

When the peripheral surface of the transport roller is formed by yarn guide elements, given a constant drive speed of the transport roller it is possible to achieve the effect whereby the peripheral speed of the peripheral surface is variable. It is equally thereby possible for the angle of wrap at the peripheral surface of the transport roller to be influenced to a slight extent.

The dimensions of the twist-stopping roller according to the invention may vary within a relatively large range. However, to enable the twist torque of the yarn to be absorbed, it has been shown that it is necessary to observe a diameter of the peripheral surface of the transport roller of at least 40 mm.

To increase the efficiency of the transport roller, it is particularly advantageous when the transport roller at the periphery has a plurality of zigzag yarn running tracks arranged parallel next to one another. In said case, the switch from one yarn running track to the next yarn running track is guaranteed by means of a second supporting roller arranged paraxially relative to the transport roller.

In general it has proved advantageous to provide the yarn running track, i.e. the regions of the transport roller contacted by the yarn as well as the deflection points at the yarn guide elements with a low-wear coating or to manufacture the yarn guides from a suitable low-abrasion, e.g. ceramic material.

In the case of the yarns, the twist may be sufficiently braked equally by means of a galette. In said case, it is necessary for the galette to have an approach edge to enable the transverse force of the yarn to be absorbed.

During operation, wear phenomena arise to a greater or lesser extent at all surfaces in contact with the yarn. Said wear phenomena however also lead to a variation in the yarn tensile force of the yarn. A further possible consequence may be unstable yarn courses. It is therefore particularly advantageous when the texturing machine according to the invention is constructed with a control device which is connected to a yarn tensile force sensor and to the drive of the transport roller. Thus, the drive of the transport roller may be directly controlled in dependence upon the measured yarn tensile force. When a setpoint value of the yarn tensile force is entered in the control device, the yarn tensile force in the yarn may be permanently corrected by means of the transport roller.

It is recommended that the yarn tensile force sensor be disposed upstream of the heating device so that the position of the developing stretch point in the heater remains substantially stable. This additionally allows a minimum level of yarn tension to be operated in the false twisting zone.

Since generally the yarn tensile force in the cooling phase is higher than in the heating phase and also should not fall below a specific level, the false twist texturing machine according to the invention is preferably to be used with a yarn tensile force sensor disposed between the heating device and the cooling device, particularly in cases where the cooling device and the heating device are arranged successively in a straight yarn course, so as to rule out an increase of the yarn tensile force by deflection yarn guides.

In a particularly advantageous development of the texturing machine according to the invention, it is provided that the yarn is directly withdrawn from a supply bobbin by means of the transport roller. In said case, not only the yarn tensile force but also the yarn speed are determined by the transport roller and the downstream delivery mechanism.

The transport roller in said case is advantageously driven by means of an electric motor. Thus, each processing point is adjustable independently of the adjacent processing points. It is therefore possible to produce a substantially equally high quality of yarn at each processing point. It is however possible for a group of adjacent transport rollers to be driven jointly by means of one drive. In said case, the transport rollers are connected to one another by a drive through-shaft which is driven by means of a motor.

It is known, e.g. from DE 33 24 243, for the delivery mechanisms of the processing points to be driven by a drive motor, the first delivery mechanisms and the second delivery mechanisms being drive-connected to one another. The delivery mechanisms of adjacent processing points are formed, in said case, by drive through-shafts.

Given such an arrangement, the lap formations which arise at the delivery mechanisms in the event of a yarn breakage are removable either only by disconnecting the entire machine or only with extreme difficulty while the drive shafts are in operation. Furthermore, when re-piecing a yarn at a processing point the problem arises that the yarn has to be pieced onto delivery mechanisms operating at the high delivery speed necessary for processing.

In air bulking machines for manufacturing loop yarns it is customary for the delivery mechanisms to be driven by individual drives, in the manner known from DE 36 23 370. Such machines have no false twisting zone, with the result that a relatively short yarn course may be realized between the supply bobbin and the take-up device. The delivery mechanisms in said case are combined into modules disposed within reach of the attendant and having one or more drives. The galettes or apron delivery mechanisms used in said case do however also have the drawback that a broken yarn leads to a lap formation which is very difficult to remove.

The particularly preferred development of the invention provides a false twist texturing machine which is notable for the fact that the first delivery mechanism is formed by a transport roller. Here, the required transport speed is transmitted to the yarn by friction forces. For said purpose, the yarn is wrapped partially in a peripheral direction around the transport roller, the yarn being deflected back and forth at right angles to its running direction so as to produce a zigzag yarn running track at the periphery of the transport roller. By virtue of said zigzag yarn running track at the periphery the friction forces at the yarn are increased to such an extent that sliding of the yarn on the peripheral surface is prevented. A further result of the zigzag yarn running track is that only a tensioned yarn is applied onto the peripheral surface of the transport roller since the slippage resistance at the deflection point of the yarn running track has to be overcome. In the event of a yarn breakage, therefore, no tight lap will form on the peripheral surface of the transport roller. The yarn will wind on at the periphery outside of the yarn running track and will therefore be easily removable.

The transport rollers are drivable in each case independently of one another so that each processing point is individually controllable. Thus, in a particularly advantageous manner so-called sympathetic yarn breakages may be avoided. A sympathetic yarn breakage occurs when the yarn breakage at one processing point leads to one or more yarn breakages at adjacent processing points. With the texturing machine according to the invention, a high operational reliability and minimum yarn spoilage are therefore achieved.

Even when setting up a false twist texturing machine according to the invention, alignment errors at the base do not result in any kind of influencing of the delivery mechanisms.

In a preferred embodiment, the transport rollers may be coupled and/or are detachably connected to the respective drives. Thus, in the event of lap formation, the transport roller may easily be removed from the processing point and replaced by a new transport roller. Non-productive periods are therefore considerably shortened.

The drives of the transport rollers preferably take the form of electric motors which are controllable by means of individual converters or group converters.

In a development of the invention, the transport rollers are driven in each case by a drive unit combined with an eddy-current brake. By virtue of such an arrangement the control outlay for the drive may be reduced.

In a further particularly advantageous embodiment of the texturing machine according to the invention, the transport roller may be attended by means of a piecing apparatus. It is therefore possible to realize short yarn courses in the machine. The transport rollers may be positioned in the machine at points which the attendant may reach only with auxiliary devices. A further advantage arises from the fact that the yarn may be conveyed with the minimum of deflections, enabling gentle treatment of the yarn with few friction points.

From EP 0 641 877 A2 a false twist texturing machine is known which comprises a winding frame, a processing frame and a creel frame. An attending aisle is formed between the winding frame and the processing frame for manually piecing each yarn in a free-running manner onto the delivery mechanisms and other treatment devices. Said construction leads to a complicated yarn course with a plurality of deflection points in the yarn course between the creel frame and the processing frame.

The particularly advantageous construction of the invention provides a false twist texturing machine which has the first delivery mechanism disposed immediately upstream of the inlet of the first heater and which has the heater and the cooling device disposed in a flush manner. The effect achieved by said arrangement is that the yarn is exposed to very little friction as it runs through the heater and the cooling rail. By means of the delivery mechanism a defined transport speed is imparted to the yarn. By virtue of the arrangement according to the invention it could additionally be possible to dispense with the use of an additional twist-stopping device upstream of the heater. The yarn twist generated by the yarn twister in the yarn course downstream of the cooling rail would continue only as far as the first delivery mechanism. In the delivery mechanism a suspension of the twist is then effected as a result of a wrap-generated friction torque or clamping action at the yarn. The twist-stopping roller therefore delimits the false twisting zone. The false twist texturing machine according to the invention is also particularly notable for its low overall height because the plane, in which the heater and the cooling device are disposed, extends horizontally or with a slight inclination relative to the horizontal.

According to the invention, the first delivery mechanism is attended by a piecing apparatus. The effect thereby achieved is that the yarn at the start of processing may be reliably pieced by an attendant or, in the event of lap formation, said laps may be removed. In said case, it is particularly advantageous when the piecing apparatus is operable from the attending aisle. It is thereby guaranteed that, at the start of processing, piecing of the yarn into the delivery mechanisms and the individual treatment devices may be carried out manually by an attendant.

The piecing apparatus in said case may comprise two portions, the piecing apparatus in the first portion being vertically displaceable in order, for example, to transfer the yarn from the attending position to the necessary working height for piecing. In the second portion the piecing apparatus is horizontally displaceable so that, for example, the yarn may be inserted into a guide roller disposed above the bobbin creel and then the yarn is conveyed to the transport roller.

An advantageous development of the false twist texturing machine has the advantage that the attending aisle and the doffing aisle for removing the textured yarn bobbins are separate from one another. As a result, the finished bobbins may be removed at any time by a removal device without the attendant being impeded thereby. The yarn is moreover conveyed immediately from the creel frame along a short route directly to the heater inlet. During said process, the yarn is conveyed advantageously only via one guide roller.

A particularly advantageous embodiment provides that the first delivery mechanism is firmly connected to a height-adjustable piecing arm of the piecing apparatus. Thus, the first delivery mechanism may be displaced back and forth between an attending position and an operating position. In the attending position, which is reachable by the attendant, the yarn is pieced manually onto the first delivery mechanism. The delivery mechanism is then brought by the piecing arm into the required operating position for the texturing process. In said case, the piecing apparatus could advantageously simultaneously effect piecing of the yarn onto the first heater in the manner known, for example, from U.S. Pat. No. RE 30159.

In an advantageous development of the false twist texturing machine according to the invention, the transport roller is firmly connected to a height-adjustable piecing arm of the piecing apparatus and is displaced by means of the height adjustable piecing arm between an attending position and an operating position. As a result, the yarn at the start of processing may be pieced by an attendant, thereby increasing piecing reliability. Furthermore, in the event of lap formation at the transport roller, an exchange of the transport roller or removal of the yarn residue may be carried out in the attending position by the attendant without auxiliary means.

A particularly preferred development of the invention results in extreme flexibility of the respective processing point. Thus, the delivery mechanisms of a processing point may be individually adjusted. In addition, in the event of yarn breakage upstream of the take-up device, the laps are also easily removable from the delivery mechanism.

The drives of the transport rollers are, in said case, connected to one another by a control device so that the delivery speeds of the delivery mechanisms of a processing point remain set at the speed ratio required for stretching of the yarn. It is therefore also possible to realize any desired speed ratio between the delivery mechanisms.

The control device is connected to a yarn tensile force sensor which is disposed inside the false twisting zone. Thus, the yarn tensile force required for the process may be influenced by means of the transport rollers. This is particularly advantageous when, after an extended period of operation, wear phenomena at the yarn-guiding parts increase the yarn tensile force required for the process up to an unacceptable level. It also allows the special running of processes with a very low level of yarn tensile force. In the event of yarn breakage, an advantageous disconnection of the transport roller may also be effected by said means.

A development of the invention provides that the control devices of a processing point are connected to a machine control unit. The possibility is therefore created of effecting a collective variation of the speed of the delivery mechanisms which is initiated via the machine control unit. Said arrangement is advantageous when, for example, the yarn speed is to be increased in the processing point. For said purpose, a collective adjustment of the processing point is effected by the machine control unit. However, the possibility also exists, e.g. for switching the delivery mechanisms over from a piecing speed to an operating speed, of the machine control unit preselecting a timing function for the control device. The timing function controls the switchover of the speeds of the delivery mechanisms in such a way that prevents the occurrence of undesirable yarn tension peaks.

In a particularly preferred development of the invention, the control device of a processing point is connected to an energy store which, in the event of a power failure, enables a controlled braking of the drives inside the processing point. It is thereby possible to prevent a power failure leading to an uncontrolled discontinuation of the process, which causes a yarn breakage.

In order at the start of the process to prevent yarn tension peaks from being generated in the yarn during piecing, it is particularly advantageous when the transport rollers of a processing point during piecing have substantially the same transport speed. Reliable piecing is thereby effected.

The yarn guide at the transport roller may be designed in such a way that angles of wrap greater than 180° may be realized at the transport roller without substantially increasing the yarn tensile force in the yarn. The yarn may be deflected by such transport rollers substantially without affecting the yarn tensile force. This is particularly advantageous for realizing compact machine-mounted accessories. It is therefore possible to combine machine components into individual modules.

A particularly advantageous development of the invention is constructed, downstream of the second delivery mechanism, with a second heater and a third delivery mechanism in the form of a transport roller. The false twist texturing machine is then particularly suitable for texturing polyester yarn. The heat aftertreatment of the yarn is effected in said case in the second heater, the yarn tensile force depending upon the speed ratio of the transport rollers upstream and downstream of the heater.

In the present case, the set heater is disposed downstream of the second delivery mechanism in the processing frame. A third delivery mechanism, which delivers the yarn for take-up, is disposed on the winding frame.

A further preferred embodiment of the false twist texturing machine has individual drives for each unit of a processing point. Extreme flexibility in terms of the processing of yarn and the machine arrangement is thereby achieved. In the take-up device, the reciprocating device and the friction roller are driven in each case by individual drives, preferably converter-controlled electric motors. The false twister is likewise equipped with an individual electric drive.

In the case of the refinement of the individual drives of the take-up device, the embodiment in which the drive of the friction roller is integrated axially in the friction roller is particularly advantageous. It is thereby possible to produce a particularly compact take-up unit.

Before the yarn is conveyed to the take-up device it is usually provided with a coating of preparing agent. Such projection devices preferably take the form of roller preparation devices. In the present case, the projection agent is conveyed from a bath onto the yarn by means of a roller. For increased flexibility of the processing point, it is particularly advantageous when said roller is driven by means of a roller motor. The roller motor in the present case is driven independently of the adjacent processing point.

In a particularly preferred embodiment of the invention, a yarn tensioning device is disposed in the yarn course upstream of the transport roller. Said yarn tensioning device is adjustable in such a way as to generate a defined preliminary tension. The yarn tensioning device in the present case may be advantageously realized by a plurality of yarn guides partially wrapped around by the yarn, one of the yarn guides being adjustable in order to vary the wrap.

The false twist texturing machine according to the invention and the method according to the invention are particularly notable for their extreme flexibility in terms of the manufacture of textured yarns. It is possible to process both fine-denier polyamide yarns and polyester yarns of a very high titre by suitably adjusting the yarn tensile force in the false twisting zone.

A piecing up method in accordance with the invention is particularly suitable for piecing the yarn at high yarn speeds. Here, for avoiding high yarn tension peaks, there is the possibility of coordinating the piecing speeds of the delivery mechanisms. The first delivery mechanism and the second delivery mechanism may therefore be operated at the same speed.

The switchover of the delivery mechanisms from the piecing speed to the operating speed is advantageously effected in accordance with a preselected timing function. It is thereby possible to effect a collective adjustment of the delivery mechanisms. The objective is however to preselect the timing function for controlling the delivery mechanisms in such a way that the draw ratio defined by the speed difference of adjacent delivery mechanisms is adjusted only upon attainment of the operating speed. By said means, unacceptable yarn tension peaks are avoided upon start-up of the machine, once the yarn has been inserted into each unit.

The false twist texturing machine according to the invention is also preferably designed as a double machine. In said case, the two machine halves are so positioned relative to one another that the processing frames lie immediately opposite one another. As a result, the electric drive components for the false twisting units and for the second delivery mechanism may be combined in a common drive cabinet.

The machine according to the invention enables a particularly gentle texturing of yarns at high texturing speeds. Because of the substantially rectilinear course of the yarn between the creel frame and the processing frame, with the yarn spanning the take-up frame, a low overall height of the machine is realized. Despite said low overall height, the false twist texturing machine is equipped with a heating and cooling section which is also suitable for high speeds of even coarse polyester yarns.

BRIEF DESCRIPTION OF THE DRAWINGS

Several embodiments are described in detail below with reference to the accompanying drawings.

The drawings show.

DETAILED DESCRIPTION OF THE PREFERRED EMBODIMENTS

Figure 1:
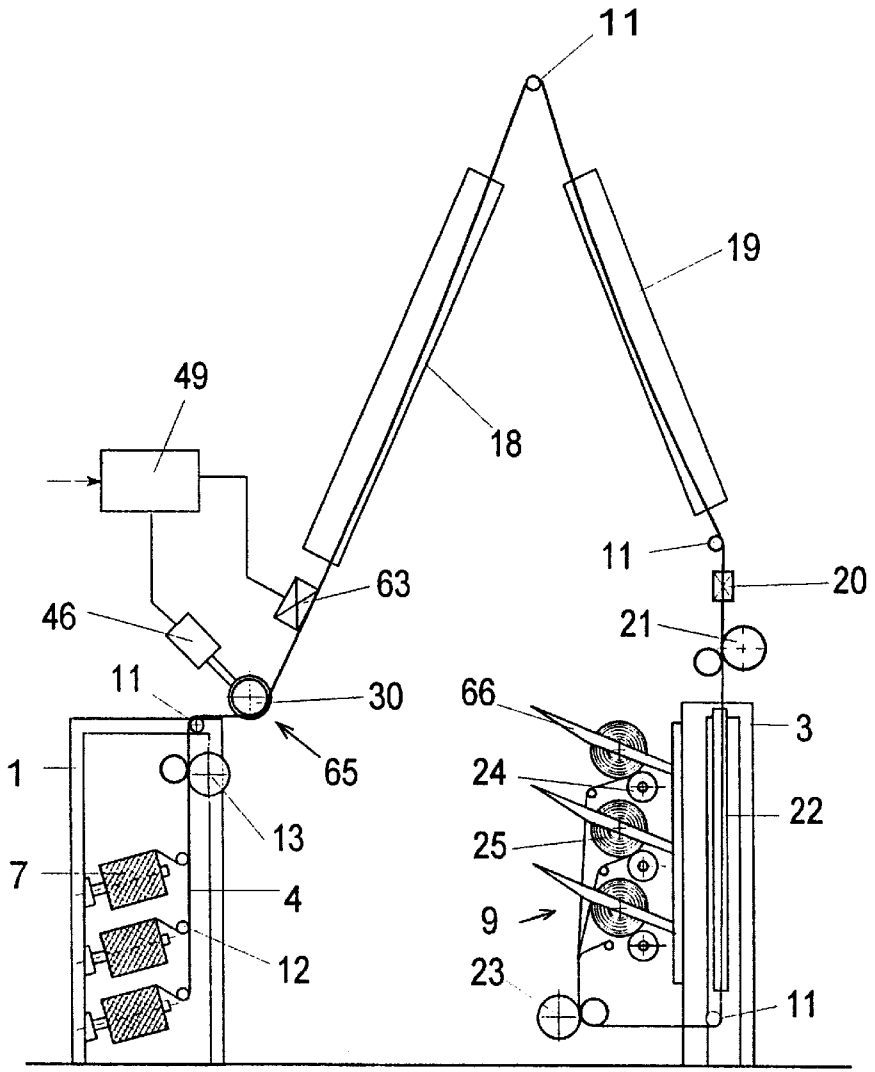
FIGS. 1 and 2 the diagrammatic representation of a false twist texturing machine according to the invention with closed-loop control of the yarn tensile force in the false twisting zone.

In the following embodiments of the false twist texturing machine according to the invention, structural parts of identical function are denoted by identical reference characters.

Figure 2:
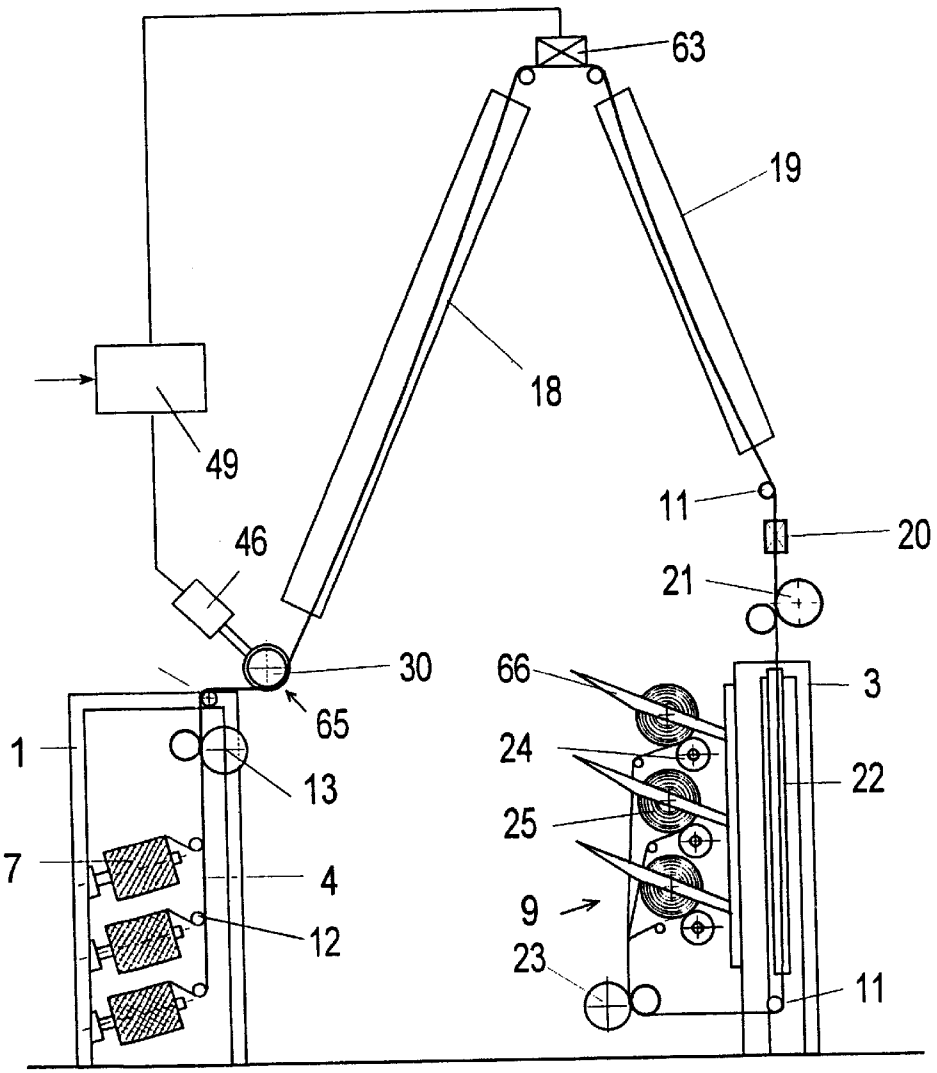
Figure 3:
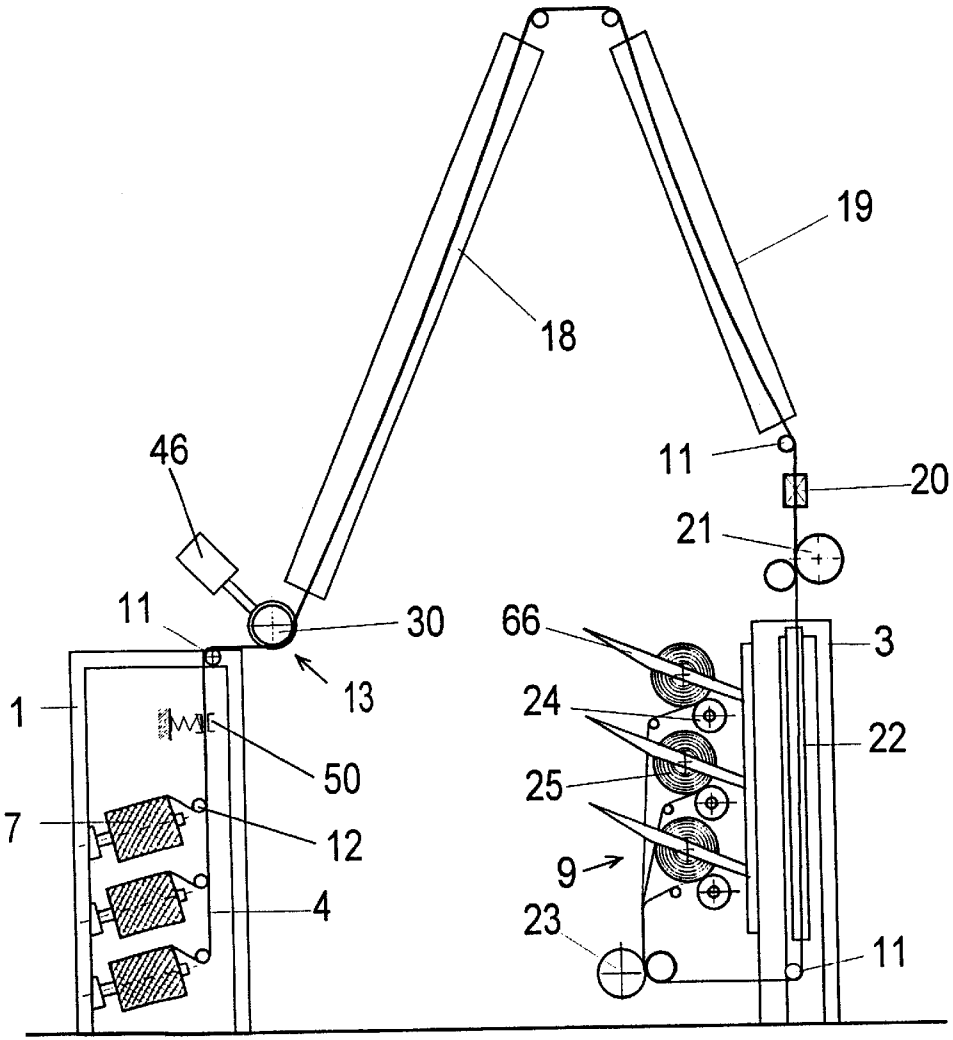
FIG. 3 the diagrammatic representation of a further embodiment of a false twist texturing machine.

The following description applies to the false twist texturing machine according to FIGS. 1 to 3. Where differences occur, this is specifically mentioned in the description.

The false twist texturing machine comprises in longitudinal direction—in the drawings, the drawing plane equals the transverse plane—a plurality of processing points, in each case one yarn per processing point being processed. Since the take-up devices take up a width of three processing points, there are in each case three winding points disposed in a column one above the other on the take-up device 9. Accordingly, there are likewise in each case three supply bobbins 7 disposed one above the other at a bobbin creel 1.

Each processing point has a supply bobbin 7, on which a thermoplastic yarn 4 is wound. The yarn 4 is withdrawn via a top yarn guide 12 under a specific tension by the first delivery mechanism 13.

The yarn 4 is then deflected by means of a guide roller 11 towards the twist-stopping device 65 and travels through an elongate heating device 18. In so doing, the yarn is heated up to a specific temperature. The heater takes the form of a high-temperature heater, in which the heating surface temperature is above 300° C. Such a heater is known, for example, from U.S. Pat. No. 5,148,666. To said extent, reference is made to said publication.

Situated downstream of the heating device 18 is a cooling device 19. The cooling device 19 takes the form of an elongate cooling rail. Between the heating device 18 and the cooling device 19 the yarn is conveyed over a guide roller 11 so that the heating device 18 and the cooling device 19 are arranged in a V shape relative to one another.

The texturing machine according to the invention is however not restricted to such an arrangement but also permits any other association between the heating device and the cooling device, e.g. to achieve a straight yarn course, in the manner later described.

Situated downstream of the cooling device 19 is a diagrammatically illustrated false twisting unit 20. Said false twisting unit 20 may take the form of a friction disc unit of the type described, for example, in U.S. Pat. No. 5,794,429.

Downstream of the false twisting unit 20, a second further delivery mechanism 21 is used to draw the yarn 4 through both the heating device 18 and the cooling device 19. Situated in yarn running direction downstream of the second delivery mechanism 21 is a set heater 22. Said set heater may take the form of a curved heating tube which is surrounded by a heating jacket, the heating tube being heated up to a specific temperature from the outside using steam. The set heater 22 could however alternatively, like the first heating device 18, take the form of a high-temperature heater.

The yarn 4 in the present case is drawn by a further third delivery mechanism 23 out of the set heater and delivered to a take-up device 9 In the take-up device 9, the yarn 4 is wound onto a take-up bobbin 25 which is supported by a conventional package cradle 66 and driven by a friction roller 24. Situated upstream of the friction roller 24 is a reciprocating device, by means of which the yarn is conveyed back and forth at the take-up bobbin 25 and wound as a cross winding onto said take-up bobbin.

The delivery mechanisms 13, 21 and 23 are driven separately and in accordance with processing requirements at different delivery speeds which are in a fixed ratio relative to one another. Said drive may be effected in a known manner with the aid of drive through-shafts, in which case the drive shafts of the three delivery mechanism groups 13, 21 and 23 are firmly coupled to one another—e.g. by means of a quick-change gearing.

In the embodiments of FIGS. 1 to 3, the twist-stopping devices 65 each take the form of a transport roller 30, around which the yarn 4 is partially wrapped. The yarn 4 is conveyed in a zigzag yarn running track on the peripheral surface of the transport roller 30, as will be described in more detail below. The transport roller 30 is coupled to a drive 46.

In the embodiment in FIG. 1, the drive 46 of the twist-stopping roller 30 is connected to a control device 49. Between the twist-stopping roller 30 and the heating device 18 a yarn tensile force sensor 63 is disposed in the yarn course. The yarn tensile force sensor 63 is connected to the control device 49. In the embodiment illustrated in FIG. 1, the yarn 4 is withdrawn from the supply bobbin 7 by the delivery mechanism 13 and delivered into the false twisting zone. The false twist is introduced into the yarn 4 by the false twisting unit 20. The false twist thus produced runs back counter to the yarn running direction as far as the twist-stopping roller 30. Thus, the yarn is conveyed in the false-twisted state through the heating device 18 and the cooling device 19. The yarn in the twisted state is stretched and set in the heating device 18, which results in a strong imprinting of the twist and hence in a good crimping result in the yarn. By means of the yarn tensile force sensor 63 the yarn tensile force immediately upstream of the inlet of the heating device 18 is measured. Said measured value is supplied to the control device 49 which, if it determines a deviation from a setpoint value, controls the drive motor 46 of the twist-stopping roller accordingly so that the desired yarn tensile force is adjusted. With said arrangement it is possible to run processes which are executed with an extremely low yarn tensile force. The yarn is drawn by the second delivery mechanism 21 out of the false twisting zone and then conveyed into an aftertreatment zone, e.g. for shrink-resistant treatment of the yarn, to the set heater 22. Here, it could also be advantageous to install an additional delivery mechanism upstream of the inlet of the set heater to enable an adjustment of the delivery speeds (lagging) in the after-treatment zone which is independent of the delivery speed adjustment of the delivery mechanisms of the false twisting zone. Between the second delivery mechanism and the additional delivery mechanism upstream of the set heater a tangle nozzle may advantageously be disposed in the yarn course to achieve an opening of the filaments for improved shrink-resistant treatment. After the heat aftertreatment, the yarn is wound into a cross-wound bobbin 25 at the take-up device 9.

The embodiment of the texturing machine according to the invention illustrated in FIG. 2, compared to the embodiment of FIG. 1, presents a further possible way of measuring the yarn tensile force in the false twisting zone. Here, the yarn tensile force sensor 63 is positioned between the heating device 18 and the cooling device 19. Said variant is particularly advantageous when a preselected yarn tensile force should be adjusted for cooling the yarn.

The embodiment according to FIG. 3 shows a preferred form of construction, in which the twist-stopping roller 30 withdraws the yarn 4 directly from the supply bobbin 7. Here, the twist-stopping device acts as the first delivery mechanism 13. The yarn speed in the false twisting zone is adjusted by the delivery speed of the transport roller 30 and the second delivery mechanism 21. In order to obtain a specific initial force for generating the friction forces at the transport roller 30, a yarn tensioning device 50 might be disposed between the top yarn guide 12 and the transport roller 30. Said embodiment is notable for a particularly simple construction and processing sequence.

Figure 4:
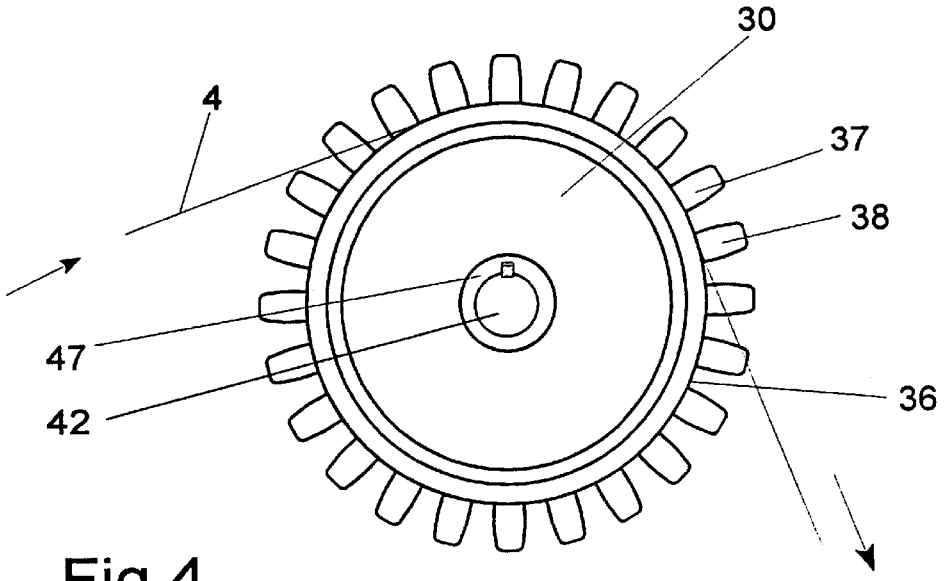
FIGS. 4 to 6 a twist-stopping device in the form of a transport roller.
Figure 5:
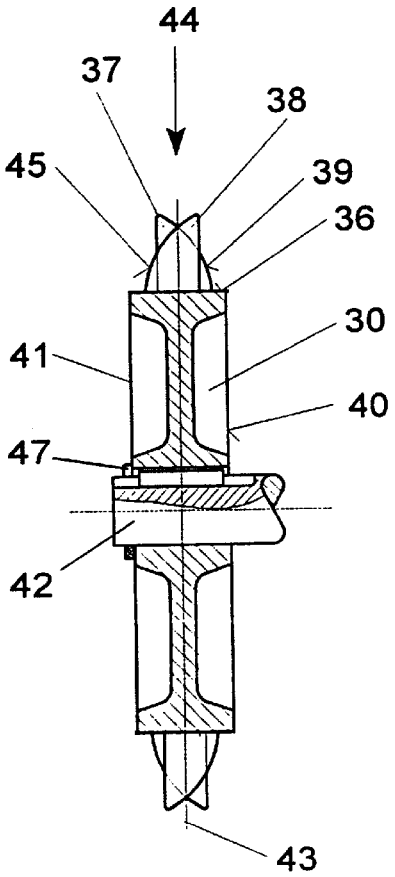
Figure 6:
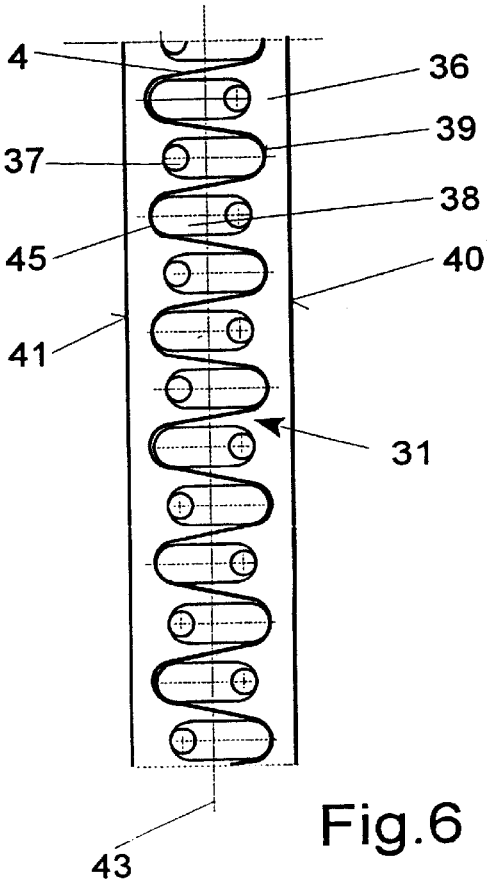

FIGS. 4 to 6 show a first embodiment of a twist-stopping roller or transport roller which could be used, for example, in the embodiments of the false twist texturing machine according to the invention of FIGS. 1 to 3. The twist-stopping device comprises a transport roller 30 which has at its periphery a zigzag yarn running track 31. The zigzag yarn running track 31 is formed by placing on the peripheral surface 36 of the transport roller a plurality of yarn guides 37 and 38 alternating in a peripheral direction and uniformly spaced apart (see FIG. 5). The yarn guides 37 have their guide edges 39 associated with the end 40 of the transport roller 30. The yarn guides 38 have their guide edges 45 associated with the opposite end 41. The guide edges 39 and 45 of adjacent yarn guides are aligned offset relative to the center plane 43 in an overlapping manner so that a yarn wrapped around the guide edges 39 and 45 adopts a zigzag yarn course at the periphery of the transport roller 30. As FIG. 5 reveals, the guide edges 39 and 45 of the adjacent yarn guides are fashioned in such a way as to form a notch 44, in which the approaching yarn 4 is caught and may slide along the respective guide edges 39 or 45 onto the peripheral surface 36. The multiple wrapping around the yarn guides 37 and 38 therefore generates a friction force which absorbs the twist torque of the yarn. The transport roller 30 is firmly coupled to a drive shaft 42 which is driven by a drive (not shown here). The yarn tensile force in the yarn is influenced by the sliding or static friction between the yarn 4 and the peripheral surface 36 as well as by the sliding or static friction between the yarn 4 and the yarn guide elements 37 and 38. As a further parameter for influencing the yarn tensile force, the angle of wrap between the yarn inlet and the yarn outlet of the transport roller 30 may be preselected. The yarn guide elements 37 and 38 are preferably made of ceramic materials.

The transport roller is mounted onto the end of a drive shaft 42. In the present case, the transport roller 30 is coupled by means of a keyed plug-in connection firmly to the drive shaft 42. The plug-in connection between the transport roller 30 and the drive shaft 42 is secured by means of a retaining ring 47. It is therefore possible to exchange the transport roller 30 with little effort.

It should be pointed out at this stage that, in the case of the delivery mechanism according to the invention, the friction force required for delivery might also be generated by clamping of the yarn.

It is equally possible for the alternating arrangement of yarn guide elements 37 and 38 to be non-uniform so that, for example, the wrap in sub-regions of the transport roller is halved by means of two successive guide elements of a disc per guide element.

The design of the transport rollers 30 is effected in such a way that the yarn tensile forces which have to be applied in a processing stage are reliably transmitted and a slip between yarn 4 and transport roller 30 is avoided in order to create, from processing point to processing point, identical delivery conditions as a prerequisite for a good product result. In particular, this is also achieved in that the yarn running track 31 extends along a geometrically clearly defined diameter so as to produce, from delivery mechanism to delivery mechanism, precisely reproducible speed and draw ratios. As parameters, it is possible in said case to vary the roller diameter, the number and hence the pitch of the yarn guides on the roller periphery, the roller width and further, by means of the selected material of the guide surfaces and by means of the arrangement of the transport rollers in the yarn course, the angle of wrap between yarn inlet and yarn outlet. It is possible, independently of the yarn material (titre, residual stretch), to adjust the yarn delivery speeds and the yarn intake tensions individually at each processing point. Said adjustability is particularly advantageous also at the start of processing for yarn piecing in order to avoid yarn tension peaks in the yarn.

Figure 7:
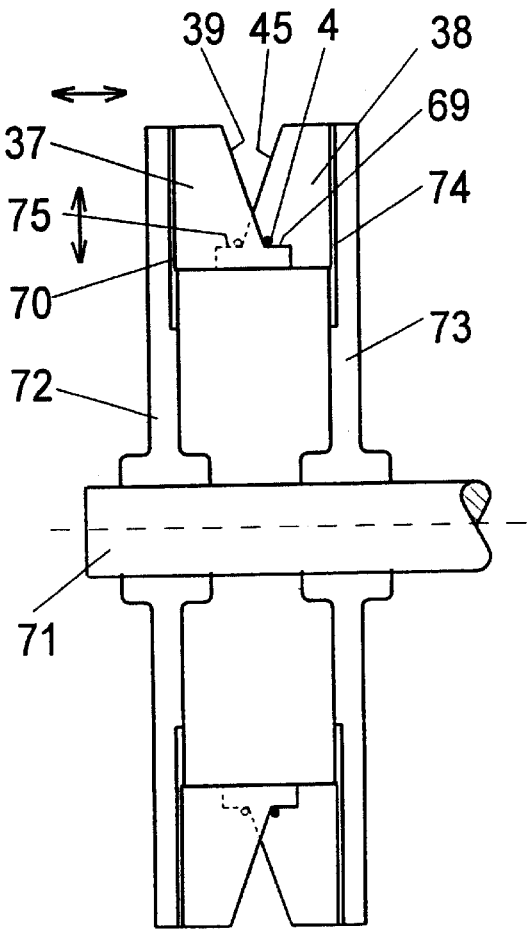
FIGS. 7 and 8 further embodiments of a twist-stopping roller.
Figure 8:
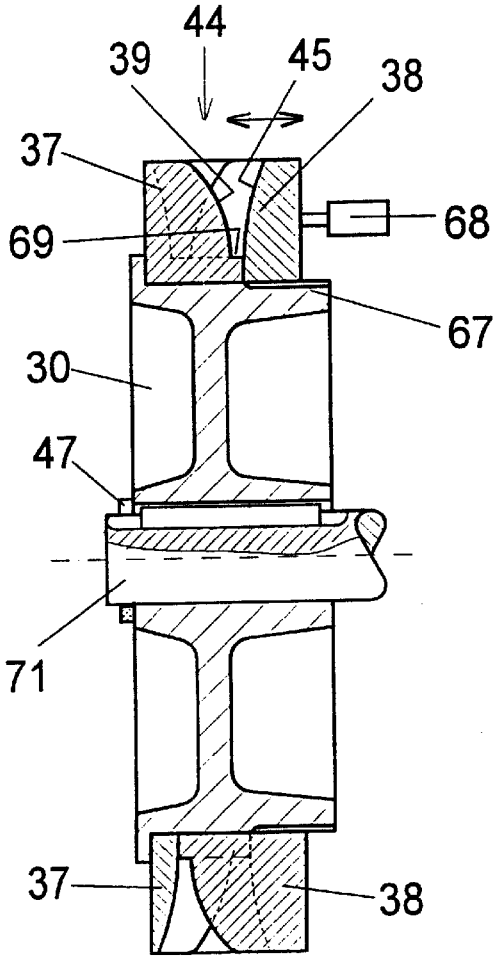

A further example of a twist-stopping roller is shown in FIG. 7. Here, the twist-stopping roller is formed by two discs 72 and 73 which are fastened coaxially with one another to a drive shaft 71. The discs, at their sides directed towards one another, have the yarn guide elements 37 and 38 at the outside edge. The yarn guide elements 37 each have a guide edge 39, which terminates in a guide surface 69 extending in a peripheral direction. The yarn guide elements 38 lying opposite in an offset manner have the yarn guide edges 45, which likewise terminate in a guide surface 75 extending in a peripheral direction. The guide surfaces 69 and 75 are situated on a diameter and therefore form a circumferential support surface for the yarn. The yarn guide elements 37 are coupled by a guide 70 to the disc 72. The yarn guide elements 38 are likewise coupled by a guide 74 to the disc 73. By radially adjusting the yarn guide elements it is therefore possible to vary the diameter of the yarn support surface formed by the guide surfaces 69 and 75. Furthermore, the discs 72 and 73 are displaceable relative to one another so that the yarn guide edges 39 and 45 overlap one another to a greater or lesser extent. By said means, an increase of the yarn wrap at the yarn guide elements 37 and 38 is achieved. Thus, in addition to the variable rotational speed, there are further parameters for the twist-stopping device which are available for influencing the yarn tensile force of the yarn. FIG. 8 shows a further embodiment of a twist-stopping roller. Here, the yarn guide elements 37 are connected to one another by a circumferential ring. The yarn guide elements 38 are likewise coupled to one another by a circumferential ring. The two annular yarn guide elements are, in said case, arranged with the projecting guide edges 39 and 45 offset relative to one another in such a way that they engage one into the other. A notch 44 is thereby formed, in which an approaching yarn slides. By virtue of the deflection by means of the guide edges 39 and 45 the yarn is therefore forced into a zigzag yarn running track. The yarn, in said case, lies on the periphery-shaped guide surface 69. The wrapping of the yarn around the guide edges 39 and 45 may be effected in the present case by axially displacing the yarn guide elements 38 by means of an adjusting device 68. The yarn guide elements 38 in the present case are connected by a guide 67 to the transport roller 30. The transport roller 30 is in turn mounted onto a drive shaft 71. For securing the connection between the transport roller 30 and the drive shaft 71, a retaining ring 47 is attached to the shaft end of the drive shaft 71.

Figure 9:
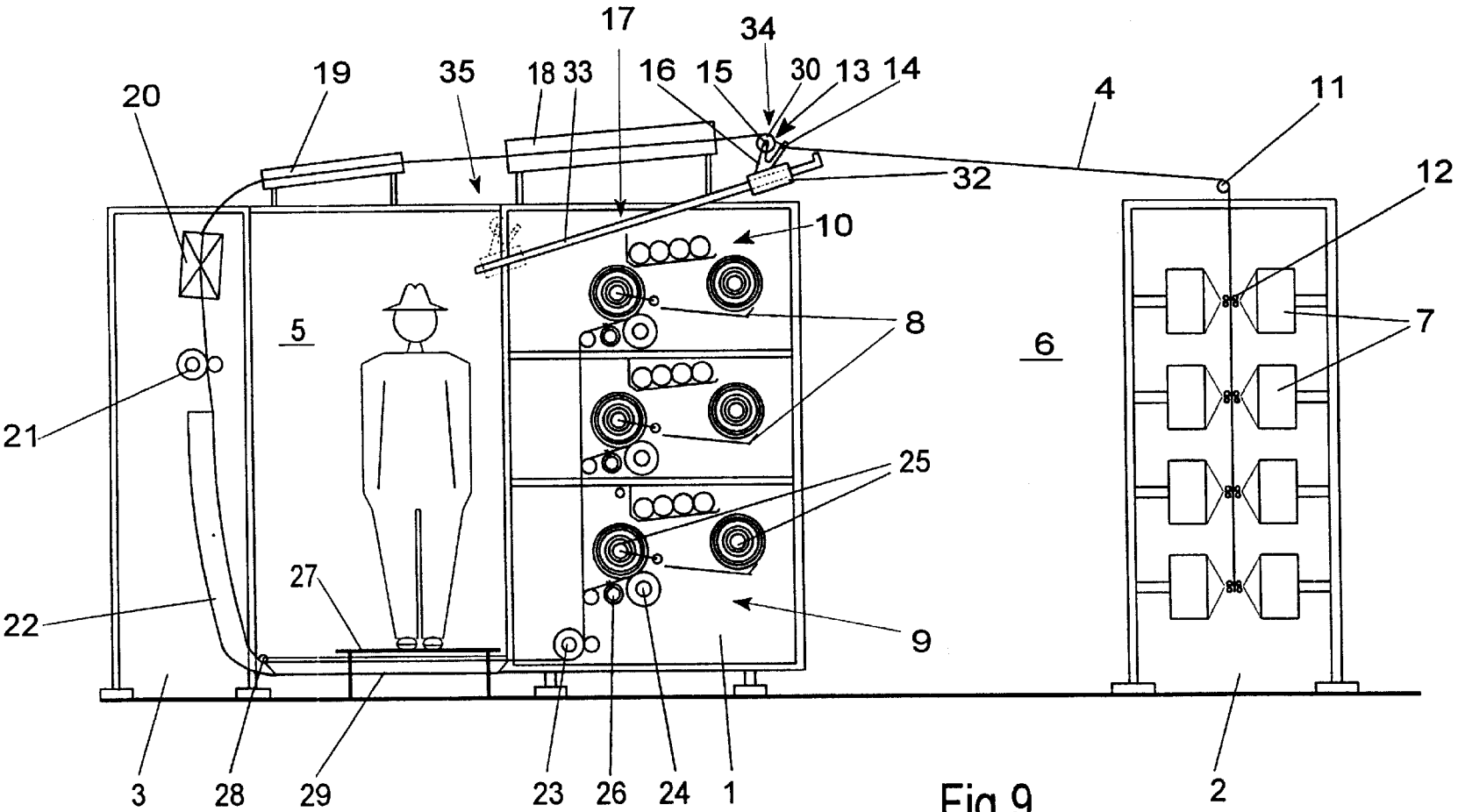
FIG. 9 a diagrammatic view of a further embodiment of a false twist texturing machine according to the invention.
Figure 10:
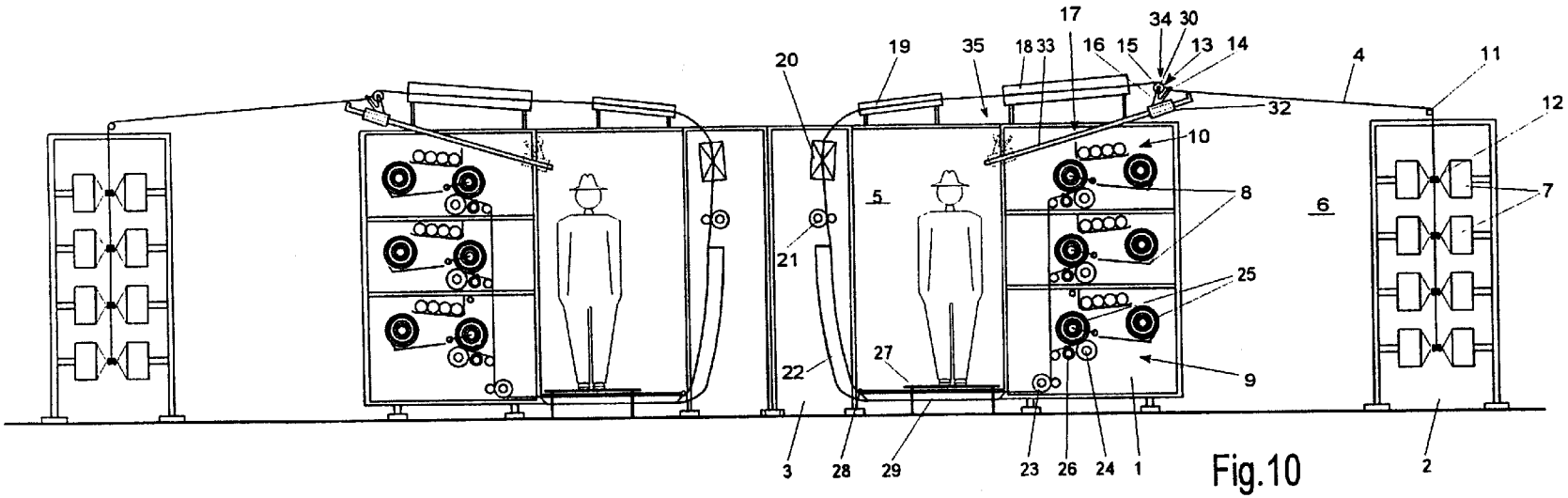
FIG. 10 a diagrammatic view of a double machine.

The following description applies to the embodiments of the false twist texturing machine according to FIGS. 9 and 10.

The false twist texturing machine comprises a creel frame 2, a processing frame 3 and a winding frame 1. An attending aisle 5 is formed between the processing frame 3 and the winding frame 1. At the opposite side of the winding frame 1 to the attending aisle 5 the creel frame 2 is disposed at a distance from the winding frame 1. Thus, a doffing aisle 6 is formed between the winding frame 1 and the creel frame 2.

The false twist texturing machine comprises in longitudinal direction—in the drawings, the drawing plane equals the transverse plane—a plurality of processing points for, in each case, one yarn per processing point. The take-up devices take up a width of three processing points. For said reason, there are in each case three take-up devices 9—more details of which are given later—arranged one above the other in a column in the winding frame 1.

Each processing point has a supply bobbin 7, on which a thermoplastic yarn 4 is wound. The yarn 4 is withdrawn via a top yarn guide 12 and a guide roller 11 or a yarn guide under a specific tension by the first delivery mechanism 13. In the embodiment according to FIGS. 9 and 10, the yarn is conveyed between the creel frame 2 and the first delivery mechanism 13 without tubular guidance. It is however possible in said case also to use tubular guides for transporting the yarn from the supply bobbin to the attending aisle.

Disposed in the yarn course upstream of the first delivery mechanism 13 is a yarn cutter 14. The yarn cutter 14 may be used to sever the yarn in the event of faults arising in the processing run between the first delivery mechanism 13 and the take-up device.

The first delivery mechanism here takes the form of a transport roller 30 which has, at its periphery, a zigzag yarn running groove 31 of the type subsequently indicated in the description relating to FIGS. 3 to 6. In the present case, the transport roller 30 is simultaneously used as a twist-stopping device for stopping the twist generated in the yarn by false twisting unit 20. One transport roller 30 is associated with each processing point. The transport roller 30 is driven by means of an individual electric drive (not shown here). The transport roller 30 and the drive are connected by a holding device 15 to a piecing arm 16. Fastened to said piecing arm there is likewise a yarn cutter 14 disposed in the yarn course upstream of the transport roller 30. The piecing arm 16 is connected to a slide 32. The slide 32 is moved by a linear drive along the guide 33 between an operating position 34—as shown in FIG. 9—and an attending position 35. Thus, at the start of processing the yarn may be pieced manually by an attendant onto the transport roller 30. The transport roller 30 is then moved into its operating position 34 by means of the piecing apparatus 17.

In the present case there is however also the possibility of the drive, which drives e.g. a group of transport rollers, being fastened in a stationary manner to the machine frame. The transport rollers might then, in their respective operating position, be couplable to the drive.

It is however also possible for the first delivery mechanism to be disposed in a stationary manner in the machine and driven, for example, by a central drive acting for a plurality of processing points. At the start of processing, the yarn is therefore conveyed from the attending position to the delivery mechanism by means of a yarn guide which is movable on the piecing apparatus. Piecing of the yarn is then effected at the delivery mechanism.

It should be expressly mentioned that the first delivery mechanism may alternatively be formed by other yarn delivery means such as, for example, delivery shafts or galettes.

Situated in yarn running direction downstream of the first delivery mechanism 13 is a first elongate heater 18, through which the yarn 4 travels, the yarn being heated up to a specific temperature. The heater might take the form of a high-temperature heater, in which the heating surface temperature is above 300° C.

Situated downstream of the heater 18 is a cooling rail 19. In the present case, the heater 18 and the cooling rail 19 are disposed in a flush manner downstream of one another so as to produce a substantially straight yarn course. Situated downstream of the cooling rail 19 is a diagrammatically illustrated false twisting unit 20.

Downstream of the false twisting unit 20 a second, further delivery mechanism 21 is used to draw the yarn 4 through both the heater 18 and the cooling rail 19. Situated in yarn running direction downstream of the second delivery mechanism 21 is a second heater 22 (set heater). Said set heater may take the form of a curved heating tube surrounded by a heating jacket, the heating tube being heated up to a specific temperature from the outside using steam. The set heater 19 might, like the first heater 18, also take the form of a high-temperature heater.

Seamlessly adjoining the second heater 22 in yarn running direction is a levelling tube 29 of the type known from U.S. Pat. No. 5,431,002. The effect thereby achieved is that the yarn 4 conveys the atmosphere of the heater 22 into the levelling tube 29. The yarn guide 28 is situated in the bend between the heater 22 and the levelling tube 29.

Situated at the outlet end of the levelling tube 29 is a further, third delivery mechanism 23. Situated upstream or downstream thereof is a preparation device (not shown) which repairs the yarn 4 before the yarn runs into a take-up device 9. In the take-up device 9 the yarn 4 is wound onto a take-up bobbin 25, which is driven at the periphery by a friction roller 24. Situated upstream of the friction roller 24 is a reciprocating device 26, by means of which the yarn 4 is conveyed back and forth at the take-up bobbin 25 and wound on the latter as a cross winding.

In the false twist texturing machines according to the invention it is possible to dispose below the second heater 22 instead of the levelling tube 29 first, instead of the yarn guide 28, the third delivery mechanism 23 and then provide a tangle nozzle followed by a further delivery mechanism. It is thereby possible to swirl the treated yarn with an adjustable yarn tensile force in the tangle nozzle by blowing air onto the yarn and to intermingle the filaments.

Situated above the levelling tube 29 is a platform 27 which is used as an attending aisle 5. The attending aisle 5 is formed between the processing frame 3 and the winding frame 1. Disposed above the attending aisle 5 is the cooling rail 19 which is supported substantially on the processing frame 3. Disposed in the processing frame in accordance with the yarn course are the false twisting unit 20, the second delivery mechanism 21 and the second heater 22. The processing frame is therefore notable for the fact that it contains only the machine parts which are used for the yarn treatment.

In the upper region of the winding frame 1, at the side remote from the attending aisle 5, the first delivery mechanism 13 is disposed immediately upstream of the inlet of the first heater 18. The first heater 18 is in turn supported on the winding frame 1. In accordance with the yarn course, the third delivery mechanism 23 is fastened in the winding frame 1 to the bottom end of the winding frame. The take-up devices 9 are moreover disposed in the winding frame 3.

The take-up device 9 comprises a bobbin store 8 which is used to receive the full package once a full take-up bobbin 25 has been produced at the take-up device. For removal of the full package 25, the spindle support is swivelled and the full package deposited onto a roll-off track. The roll-off track is part of the bobbin store 8. The full package 25 waits on the roll-off track until it is carried away. For said reason, the roll-off track of the bobbin store 8 is disposed at the side of the winding frame 1 which is adjacent to the doffing aisle 6 and remote from the attending aisle 5. The doffing aisle 6 extends along the winding frame 1 and is formed between the creel frame 2 and the winding frame 1. It is used for removal of the full packages waiting at the bobbin store 8. There is further associated with each take-up device 9 a tube supply device 10 which is not described in any greater detail. Said device is a tube store where a plurality of empty tubes are temporarily stored. Once a take-up device 9 has produced a full package on the spindle support and the full package has been deposited at the bobbin store, an empty tube is fed to the spindle support and fastened thereon.

The arrangement of the frame parts in the false twist texturing machine according to the invention is such that the yarn from the supply bobbin to the take-up device describes a path in the shape of a 6. The yarns are conveyed from the creel frame in a straight level course over the winding frame 1 to the processing frame 3. In the present case, the first delivery mechanism 13 is incorporated into the yarn course in such a way that the yarn is conveyed without significant deflection from the guide roller 11 at the creel frame 2 to the false twisting unit 20 at the processing frame 3. Said very protective guidance of the yarn enables the use of texturing speeds in excess of 1200 m/min.

The guide roller 11 disposed between the first delivery mechanism 13 and the top yarn guides 12 may alternatively be replaced by a yarn guide.

A particular advantage of the false twist texturing machine is that the processing frame 3 is disposed at an outside of the machine. It is thereby advantageously possible—in the manner shown in FIG. 10—to form a double machine. In such a machine, the processing frames of the machine halves are disposed immediately adjacent to one another so that the electric drive components for the false twisting unit and the delivery mechanisms are integrated centrally in a switchgear cabinet disposed at the processing frame. The second machine half is therefore attached in a mirror-inverted manner to the first machine half.

Figure 11:
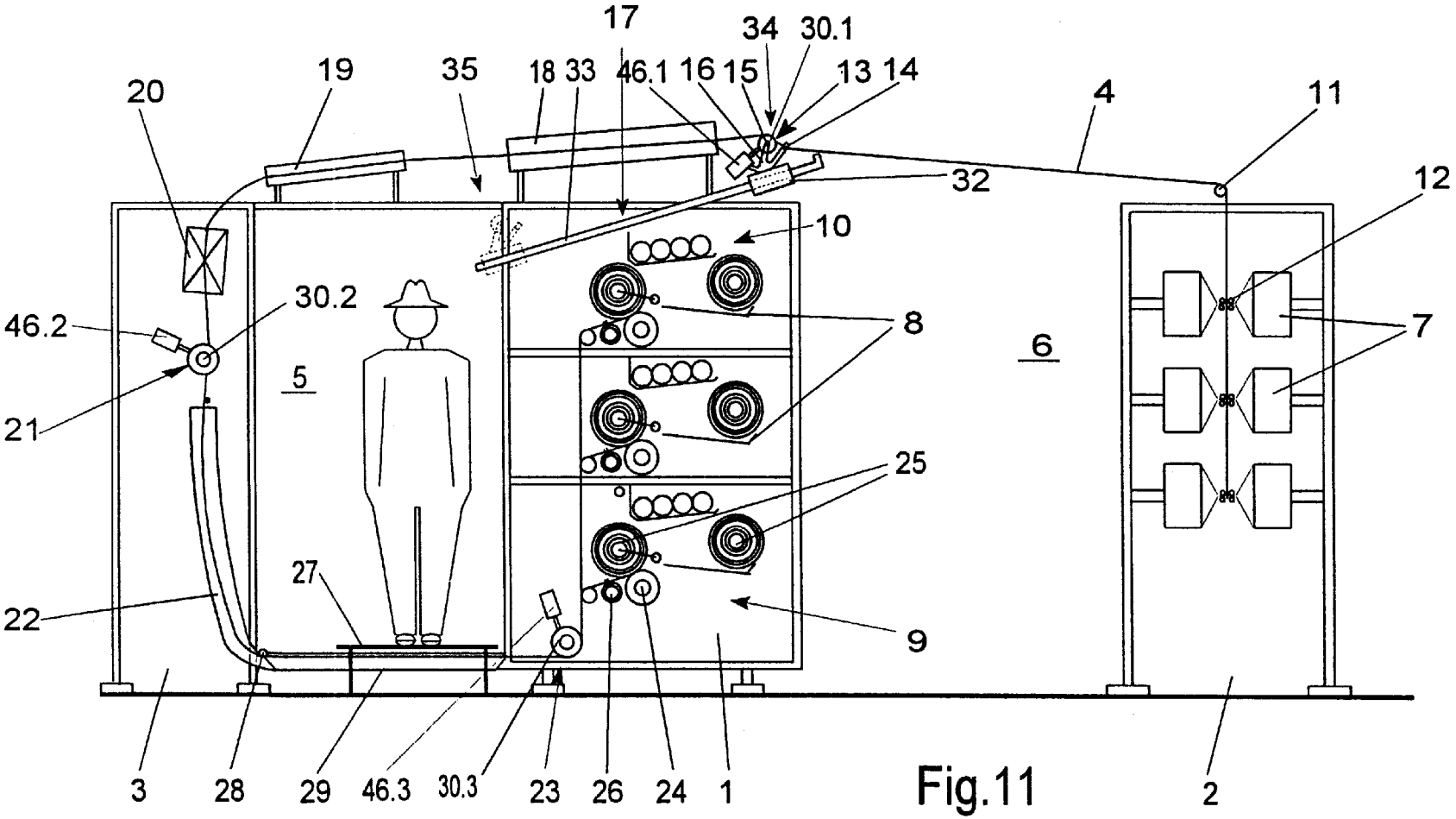
FIG. 11 a diagrammatic view of a further embodiment of the false twist texturing machine according to the invention.

As the false twist texturing machine according to FIG. 11 is very similar in construction to the false twist texturing machine according to FIG. 9, reference is made at this point to the description relating to FIG. 9.

In the false twist texturing machine according to FIG. 11, the delivery mechanisms 13, 21 and 23 each take the form of a transport roller 30.1; 30.2; 30.3 having, on its periphery, a zigzag yarn running groove of the type previously described in the description relating to FIGS. 4 to 6. The transport rollers 30.1, 30.2 and 30.3 are associated with a processing point. The transport rollers are driven in each case by means of an individual electric drive 46.1; 46.2; 46.3.

The transport roller 30.1 and the drive 46.1 are connected by a holding device 15 to a piecing arm 16. Here, a yarn cutter 14 disposed in the yarn course upstream of the transport roller 30.1 is likewise fastened to the piecing arm. The piecing arm 16 is connected to a slide 32. The slide 32 is moved by a linear drive along the guide 33 between an operating position 34—as shown in FIG. 11—and an attending position 35. Thus, the yarn at the start of processing may be pieced onto the transport roller 30.1 manually by an attendant. The transport roller 30.1 is then moved into its operating position 34 by means of the piecing apparatus 17.

Here, there is however the possibility of the drive 46.1 being fastened in a stationary manner to the machine frame. The transport rollers 30.1 could then, in their respective operating position, be coupled to the drive.

For further increased flexibility in the processing point, both the take-up device 9 and the false twisting unit 20 may be driven independently of the adjacent processing points. To said end, the take-up device 9 has two drives. The first drive is used to drive the friction roller 24. Said drive is advantageously formed by an axle-hung motor which is integrated in the axle of the friction roller. The second drive is used to drive the reciprocating device 26. Said drive could be a stepping motor which moves a yarn guide back and forth by means of a belt drive. By virtue of said arrangement, the individual adjustability of the delivery mechanisms may be used to produce different yarns inside one texturing machine.

Figure 12:
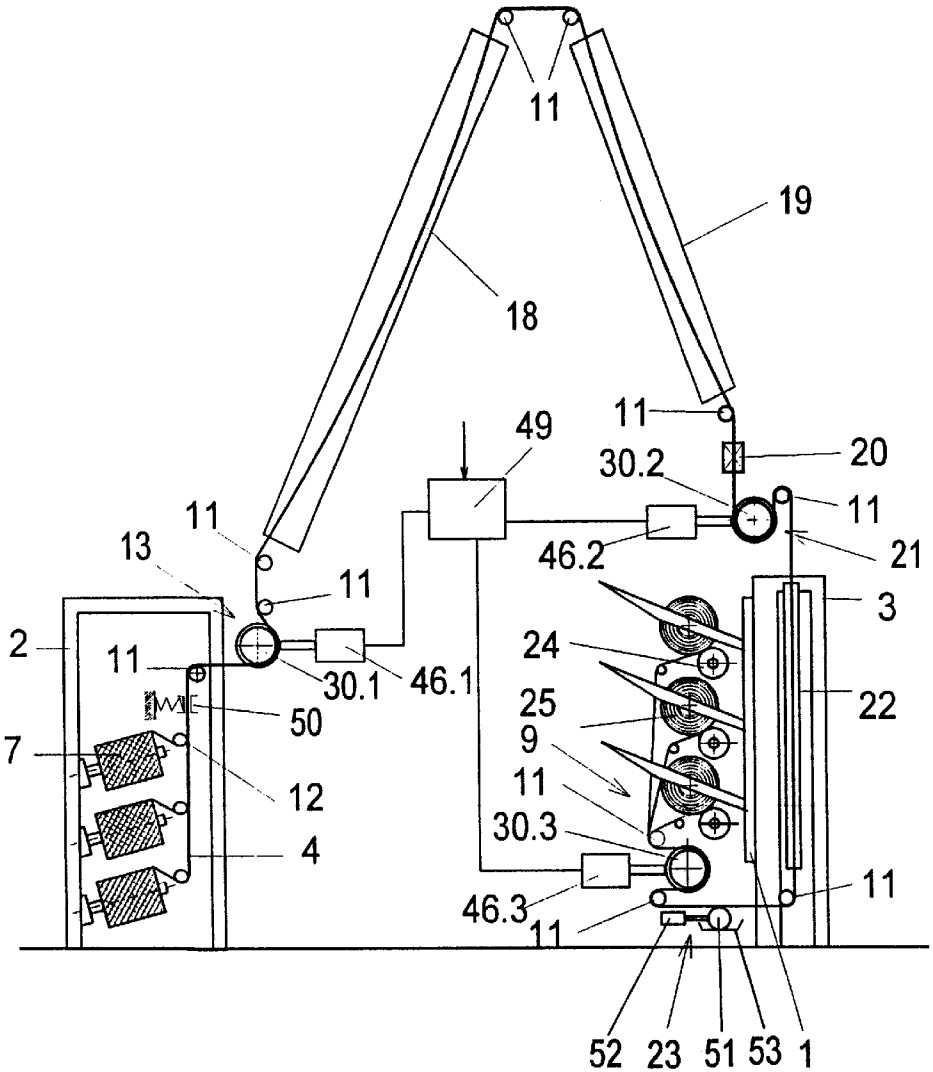
FIGS. 12 and 13 further embodiments of the false twist texturing machine according to the invention with individual drives.

In FIG. 12, the cross section of a further embodiment of the false twist texturing machine according to the invention is diagrammatically illustrated. Here, the individual components of the machine are identical to the machine illustrated in FIG. 11. To said extent, reference is made to the description relating to the embodiment according to FIG. 11. The arrangement of the components in the embodiment according to FIG. 12 results in a kinked yarn course between the heater 18 and the cooling rail 19. The yarn transport through the machine is effected by the delivery mechanisms 13, 21 and 23. Here, the yarn 4 is withdrawn from the supply bobbin 7 by the first delivery mechanism 13. A yarn tensioning device 50 is disposed between the supply bobbin 7 and the first delivery mechanism 13 in order to build up a minimum yarn tensile force.

The delivery mechanisms 13, 21 and 23 are again formed in each case by a transport roller having a zigzag yarn running track on the periphery of the roller. Guide rollers 11 are disposed upstream and/or downstream of the transport rollers 30.1; 30.2; 30.3 in order to fix the degree of wrap around the transport roller. Each of the transport rollers is driven by means of an electric motor 46.1; 46.2; 46.3. The electric motors of a processing point are connected to a control device 49. By means of the control device 49 the motors are supplied with the respective setpoint delivery speeds of the rollers. The draw ratio adjusted between the transport roller 30.1 and 30.2 is therefore held substantially constant.

Besides the yarn speed there is however also the possibility of controlling the transport rollers in dependence upon the yarn tensile force. For said purpose, a yarn tensile force sensor might be disposed in or downstream of the false twisting zone and supply its signals to the control device 49.

A preparation device is disposed upstream of the third delivery mechanism 23. The preparation device here comprises a preparation roller 51. The preparation roller 51 is driven by means of the roller motor 52. The preparation roller 51 is disposed in such a way that the yarn 4 touches its surface. Fastened below the preparation roller 51 is a trough 53 filled with the preparing agent. When the preparation roller 51 is rotated, preparing agent is therefore entrained from the trough 53 on the surface of the roller and brought into contact with the yarn 4. Said arrangement has the advantage that the yarns of the processing point may be individually prepared without influencing the yarns in the adjacent processing point.

Figure 13:
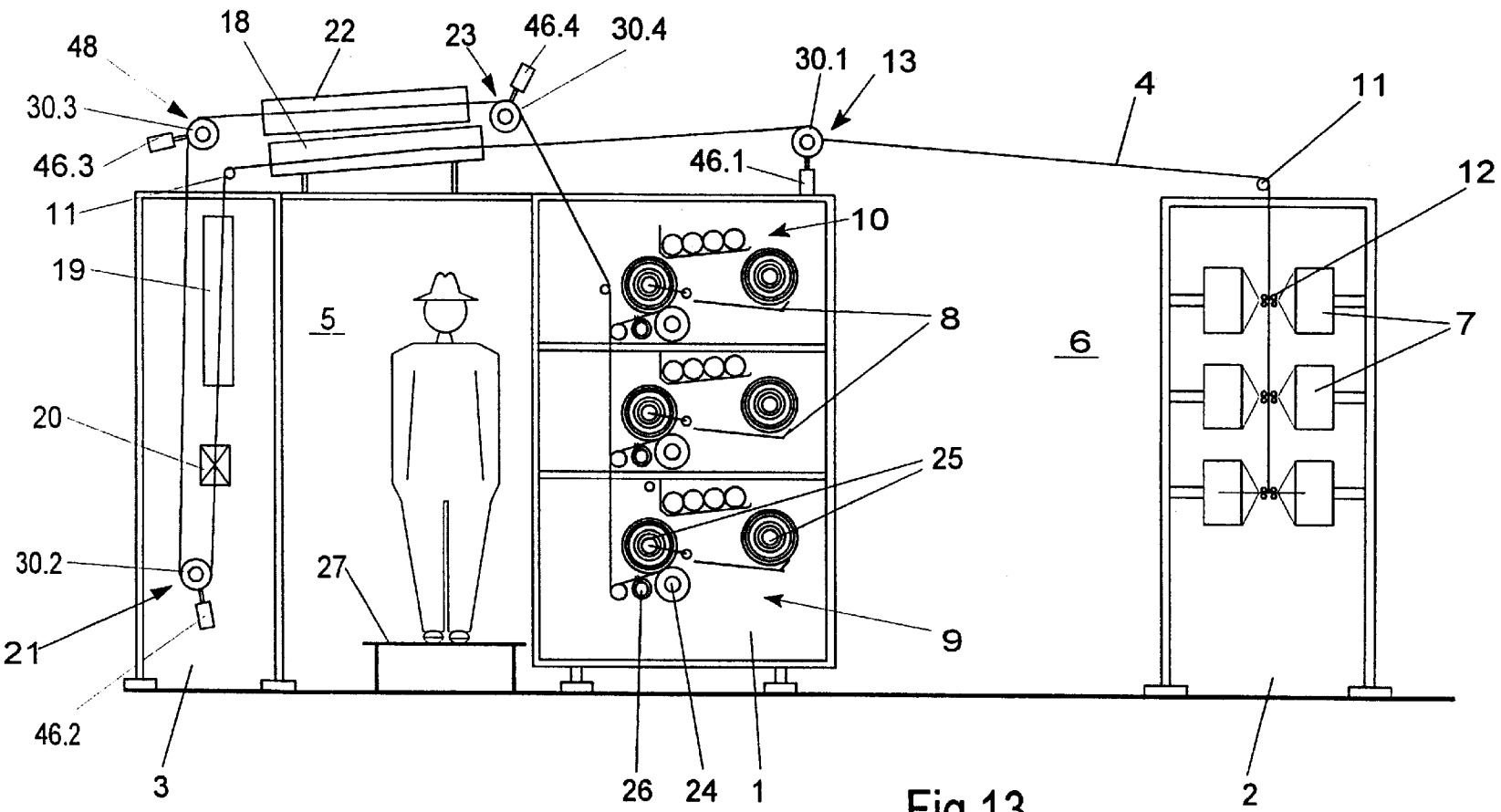

FIG. 13 shows a further embodiment of a false twist texturing machine. The arrangement of the frame parts and components corresponds substantially to the constructional variant according to FIG. 11. Reference is therefore made to the description relating to FIG. 11.

In the embodiment of the false twist texturing machine according to FIG. 13, the second heater 22 and the first heater 18 are combined into a heater module. To said end, the yarn 4 after passing through the false twisting unit is deflected through 360° at the delivery mechanism 21. The yarn 4 in the present case is withdrawn by an additional delivery mechanism 48 from the second delivery mechanism 21 and delivered to the second heater 22. The yarn tensile force required for the heat aftertreatment is adjusted between the delivery mechanism 48 and the third delivery mechanism 23. The yarn 4 then runs from above into the take-up device 9.

The delivery mechanisms 13, 21, 48 and 23 are formed by the transport rollers 30.1 to 30.4. Each of the transport rollers 30.1 to 30.4 is connected to a drive 46.1 to 46.4. Control of such drives is again effected via a central control device (not shown here).

Figure 14:
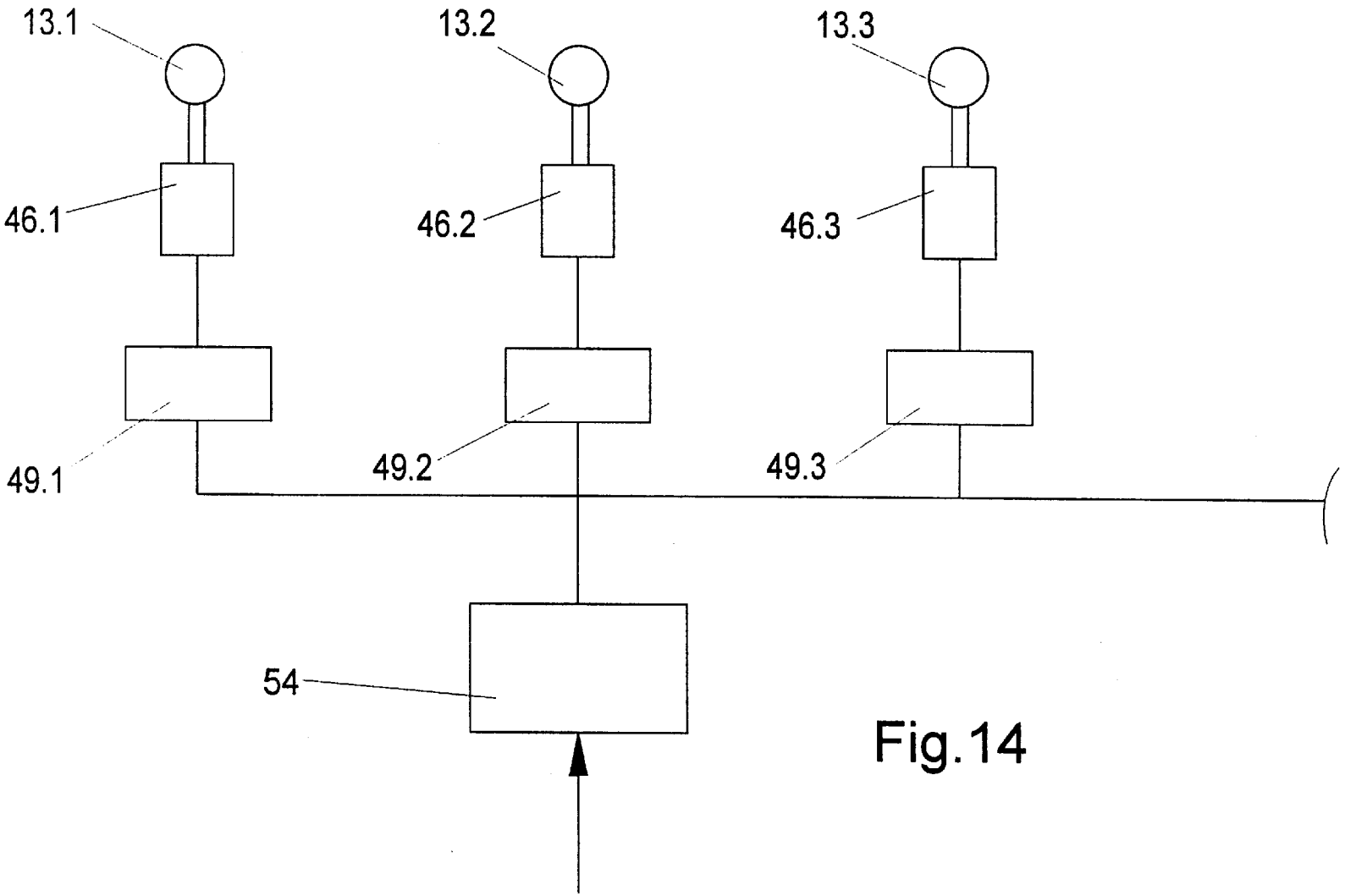
FIG. 14 a further embodiment of a machine control unit of a texturing machine from FIG. 11.

FIG. 14 shows a further embodiment of a control concept of a false twist texturing machine according to FIG. 11. In said arrangement the first delivery mechanisms 13.1, 13.2 and 13.3 per processing point, which are adjacent in a longitudinal direction of the machine, are shown. The delivery mechanisms 13.1, 13.2 and 13.3 are driven in each case by means of a drive 46.1; 46.2; 46.3. Associated with each drive is a control device 49.1; 49.2; 49.3. The possibility therefore exists of controlling each of the delivery mechanisms individually. The control devices 49.1, 49.2 and 49.3 are connected to a central machine control unit 54. The machine control unit 54 may therefore intervene directly in the individual control of the delivery mechanisms 13.1, 13.2 and 13.3. Thus, a collective adjustment of the delivery mechanisms is possible. Such an arrangement is also particularly suitable for effecting a controlled braking of the delivery mechanisms in the event of a power failure. To said end, an energy store coupled to the machine control unit 54 and associated with each delivery mechanism is activated so that a controlled braking is possible. The energy store is connected to the control device associated with the delivery mechanism.

In order after piecing to switch the delivery mechanisms over from a piecing speed to the required operating speed, timing functions are preselected for the control devices and used to control each of the delivery mechanisms. In particular, the speed ratio between the first delivery mechanism and the second delivery mechanism, which determines the stretching of the yarn in the false twisting zone, is not adjusted until shortly before attainment of the final operating speed inside the processing point. The timing function in the present case may effect a ramp-like, progressive or alternatively degressive variation of the rotational speed.

In the embodiment of a control concept of the false twist texturing machine illustrated in FIG. 14, the individual control devices 49.1, 49.2 and 49.3 may also be combined into a single control device. Such an arrangement is used particularly in cases where only a collective adjustment of the delivery mechanisms is required.

Figure 15:
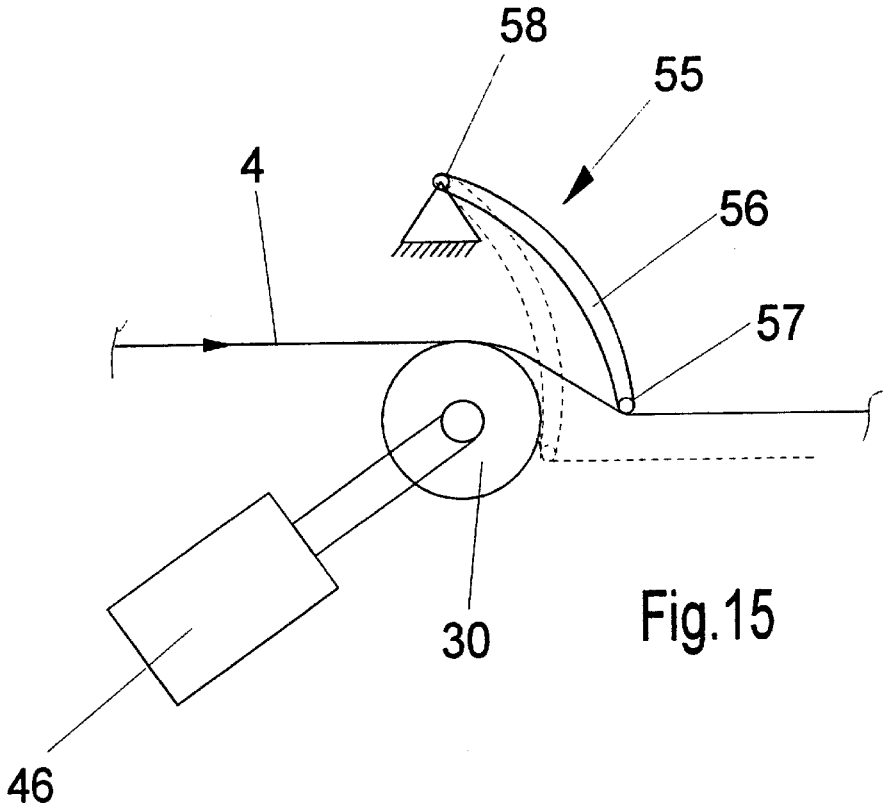
FIG. 15 a delivery mechanism with yarn deflection device.

In order, particularly in the false twist texturing machine according to FIG. 11, to enable gentle yarn piecing at the first delivery mechanism, a yarn transfer device 55 is associated with the delivery mechanism, e.g. in the manner shown in FIG. 15. The yarn transfer device 55 here may comprise a swivel arm 56 pivotally supported on a swivelling axle 58. The swivelling axle 58 is fastened in the machine frame of the texturing machine. A yarn guide 57 is attached to the opposite free end of the swivel arm 56. The yarn guide 57 may, as a result of the swivelling motion of the swivel arm 56, penetrate the yarn running plane. Depending on the position of the swivel arm 56, the yarn 4 at the yarn guide 57 is then transferred in such a way as to set an angle of wrap at the roller 30 which is adjusted in dependence upon the position of the swivel arm. Since the angle of wrap at the roller 30 influences the level of the pressure forces to be transmitted, it is therefore possible with the yarn deflection device also to influence the yarn tension in the yarn 4. The swivel arm 56 could in said case be connected to a drive, which is wired up with a control device and a yarn tension meter in a control loop. By virtue of such a closed-loop control, each yarn tension required for the process may be adjusted directly by the size of the angle of wrap at the roller 30.

Figure 16:
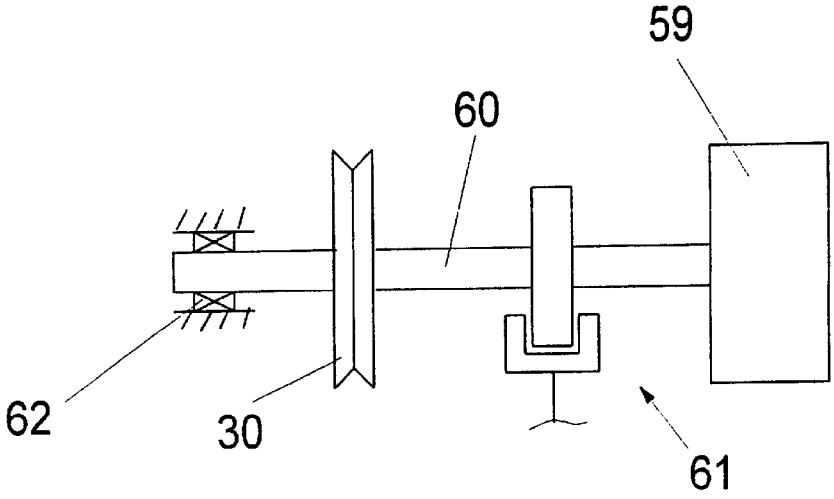
FIG. 16 a further embodiment of a drive for a delivery mechanism.

FIG. 16 shows a further embodiment of a drive of a transport roller 30. For said purpose, the transport roller 30 is fastened on a shaft 60. The shaft 60 is supported at one free end in a bearing 62 on the machine frame. At the opposite free end, the shaft 60 is coupled to a drive drive 59. The drive drive 59 here might be formed by a pneumatically operated turbine. Acting on the shaft 60 in its section between the transport roller 30 and the drive unit 59 is an eddy-current brake 61. Thus, in a simple manner the peripheral speed of the transport roller may be controlled. The drive unit 59 drives the shaft 60 with a constant driving torque. The peripheral speed of the transport roller is then controlled by braking the drive shaft 60 to a greater or lesser extent.

Figure 17:
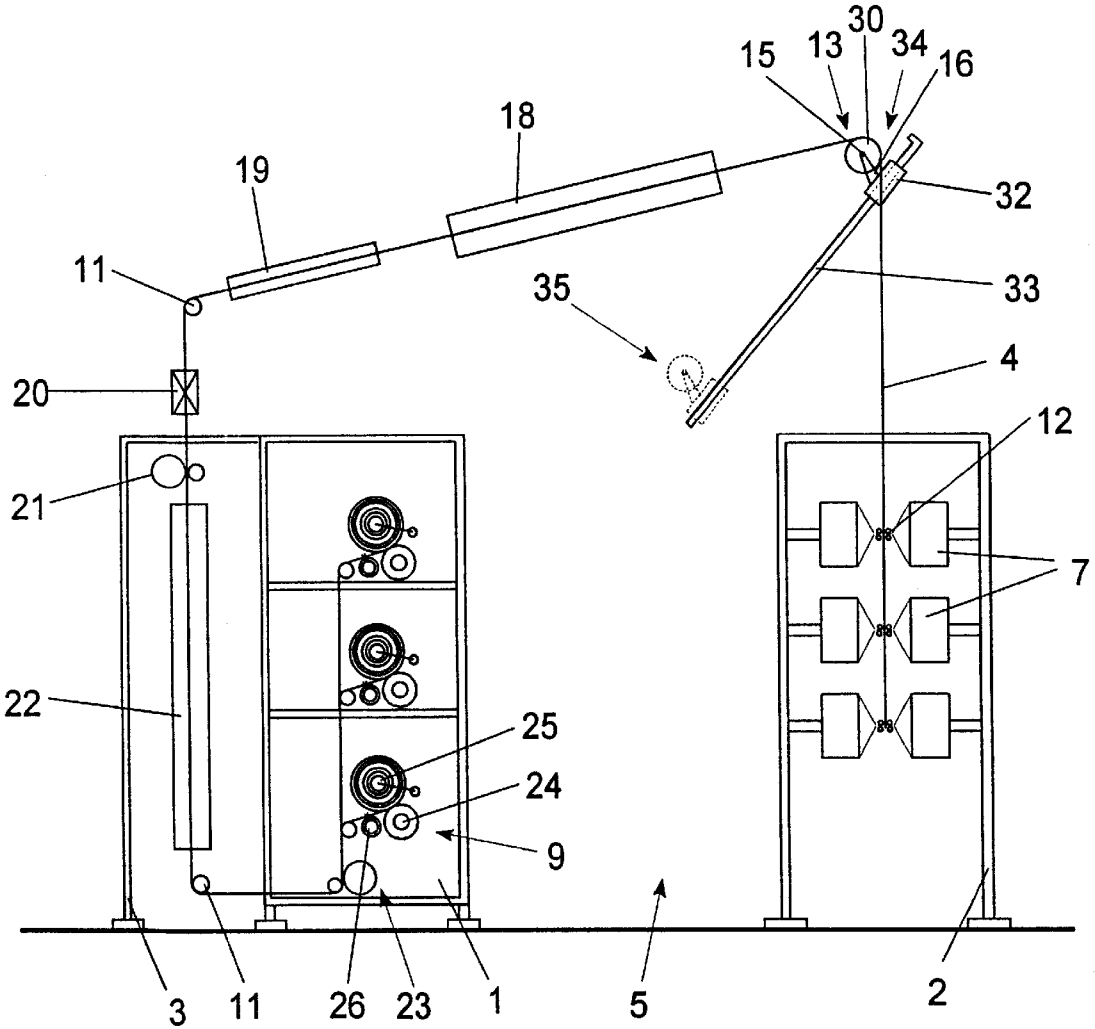
FIG. 17 a further embodiment of a false twist texturing machine according to the invention.

FIG. 17 shows a further embodiment of a false twist texturing machine according to the invention. Here, one machine half of a semi-automatic false twist texturing machine is illustrated. Since both machine halves are attached in a mirror-inverted manner to one another, only one half of the double machine is illustrated in FIG. 17 and described.

The machine—as already previously described with reference to FIG. 9—comprises a creel frame 2, a winding frame 1 and a processing frame 3. A plurality of supply bobbins 7 are arranged in tiers one above the other in the creel frame 2. An attending/doffing aisle 5 is formed between the creel frame 2 and the winding frame 1. Disposed in a flush manner above the machine frames are the first delivery mechanism 13, the heating device 18 and the cooling device 19. A false twisting unit 20 and a second delivery mechanism 21 are supported on the processing frame 3. The processing frame 3 is disposed at the opposite side of the winding frame to the creel frame. Winding frame 1 and processing frame 3 directly abut one another. In the processing frame a second heater 22 is disposed below the second delivery mechanism 21. The winding frame 1 is used to receive the take-up device 9. Here too, a plurality of take-up devices are arranged in tiers one above the other. In each of the take-up devices the yarn is wound into a yarn bobbin 25. The yarn bobbin 25 is disposed on a spindle which is driven via a friction roller 24. A reciprocating device 26 is inserted in the yarn course upstream of the yarn bobbin.

In said arrangement, the first delivery mechanism 13 is formed by a transport roller 30. The transport roller 30 is fastened by a drive (not shown here) to a height-adjustable slide 32. The slide 32 may be moved along the guide 33 between an attending position 35 and the operating position 34.

In said arrangement, the yarn 4 is conveyed along the straight yarn course from the top yarn guides 12 of the creel frame 2 to the transport roller 30 and passes from there into the false twisting zone of the machine. The false twisting zone is delimited by the false twisting unit 20 and the transport roller 30. The heating device 18 and the cooling device 19 are arranged flush inside the false twisting zone. At the outlet of the cooling device 19, the false-twisted yarn passes via a guide roller 11 to the false twisting unit 20. The second delivery mechanism 21 conveys the yarn from the false twisting zone into the downstream second heater 22. From there, the yarn passes via a third delivery mechanism 23 to the take-up device 9. In the take-up device 9, the yarn is then wound into a yarn bobbin 25. Once the bobbins 25 have been completely wound, a doffing apparatus is used to effect the bobbin change at the false twist texturing machine. To said end, a plurality of handling devices which are preferably pneumatically operated are disposed on the doffing apparatus. For the bobbin change, the doffing apparatus travels into the attending/doffing aisle 5 so that the bobbin change is effected simultaneously in each take-up device 9 by means of the handling devices. For said purpose, the yarns are first collected into a bundle, cut and removed by suction. The full packages are released and removed. An empty tube is then inserted in each take-up device. The yarns are inserted for winding. Each activity is effected by the handling devices of the doffing apparatus. The new winding process in the take-up device may begin.

In said semi-automatic false twist texturing machine also, it is possible to realize a particularly gentle yarn processing. By virtue of the arrangement of the first delivery mechanism immediately upstream of the heater inlet of the heating device 18 and above the creel frame 2, a yarn course having few deflections is realized.

What is claimed is:

1. A yarn false twist texturing apparatus comprising false twist imparting means for imparting twist to an advancing yarn and comprising an elongate yarn heater, an elongate cooling plate, and a false twist unit, a yarn delivery mechanism positioned downstream of the false twist unit for advancing a yarn serially along the yarn heater, along the cooling plate, through the false twist unit, and then to a take-up device, and a twist stopping device positioned upstream of the yarn heater for stopping the twist which runs back in the advancing yarn from the false twist unit, and comprising a rotatable transport roller about which the yarn is at least partially wrapped and a drive for controlling the rotation of the roller so that the yarn may be braked or advanced thereby.

2. The apparatus as defined in claim 1 wherein the transport roller is configured to define at least one non-slip yarn running track about its circumferential periphery.

3. The apparatus as defined in claim 1 wherein the transport roller includes a plurality of yarn guide elements disposed about its circumferential periphery, with the guide elements having oppositely directed guide edges which define a zigzag yarn running track about the circumferential periphery.

4. The apparatus as defined in claim 3 wherein the guide edges of the yarn guide elements have a radius of curvature of at least 1.5 mm.

5. The apparatus as defined in claim 3 wherein the guide edges of the yarn guide elements are configured so that the zigzag yarn running track forms an angle of at least about 100° as it moves across each guide element.

6. The apparatus as defined in claim 1 wherein the transport roller includes a pair of discs mounted on a common shaft, with each disc mounting a plurality of guide elements about its circumferential periphery, with the guide elements of each disc having guide edges which face the opposite disc so as to define a zigzag yarn running track about the periphery of the roller.

7. The apparatus as defined in claim 6 wherein the discs are axially adjustable on said shaft, and wherein the guide elements are mounted on said discs to permit radial adjustment thereof, so that the diameter of the yarn running track and the peripheral wrap of the yarn about the transport roller can be varied.

8. The apparatus as defined in claim 1 wherein the transport roller includes a base roll having an outer periphery, a pair of rings mounted on said outer periphery, with each ring mounting a plurality of guide elements about its circumferential periphery, with the guide elements of each ring having guide edges which face the opposite ring so as to define a zigzag yarn running track about the periphery of the roller.

9. The apparatus as defined in claim 8 wherein the rings are axially adjustable on the outer periphery of said base roll, so that the diameter of the yarn running track and the peripheral wrap of the yarn about the transport roller can be varied.

10. The apparatus as defined in claim 1 further comprising a moveable yarn deflection device mounted adjacent the transport roller so as to permit adjustment of the looping angle of the yarn about the transport roller.

11. The apparatus as defined in claim 1 wherein the transport roller has a diameter of at least 40 mm.

12. The apparatus as defined in claim 1 further comprising a yarn tension sensor positioned to monitor the tension of the advancing yarn, and a control device for controlling the drive of the transport roller in response to the output of the tension sensor.

13. The apparatus as defined in claim 12 wherein the tension sensor is positioned upstream of the yarn heater.

14. The apparatus as defined in claim 12 wherein the tension sensor is positioned between the yarn heater and the cooling plate.

15. The apparatus as defined in claim 1 wherein said transport roller is positioned to withdraw the yarn directly from a supply bobbin, and wherein the yarn speed and draw ratio may be adjusted between the transport roller and the yarn delivery mechanism.

16. A yarn false twist texturing apparatus comprising a plurality of side-by-side yarn processing stations, with each yarn processing station comprising a yarn supply bobbin, a first yarn delivery mechanism for withdrawing a yarn from the yarn supply bobbin, an elongate yarn heater, an elongate cooling plate, a false twist unit, a second yarn delivery mechanism for advancing the yarn from the first yarn delivery mechanism serially along the yarn heater, along the cooling plate, and then through the false twist unit, said first yarn delivery mechanism including a rotatable transport roller about which the yarn is at least partially wrapped and a drive for controlling the rotation of the roller so that the yarn may be braked or advanced thereby, and a drive control for controlling the drive of the transport roller of the first yarn delivery mechanism independently of the second yarn delivery mechanism and independently of the adjacent transport rollers of the first yarn delivery mechanisms of adjacent yarn processing stations.

17. The apparatus as defined in claim 16 wherein the drive is detachably coupled to the transport roller.

18. The apparatus as defined in claim 16 wherein said rotatable transport roller of said first yarn delivery mechanism has at least one zigzag yarn running track along its periphery.

19. The apparatus as defined in claim 16 wherein said drive controlling the rotation of the transport roller comprises an electric motor.

20. The apparatus as defined in claim 16 wherein said drive for controlling the rotation of the transport roller comprises a drive unit for rotating the transport roller and an eddy current brake for controlling the peripheral speed of the transport roller.

21. The apparatus as defined in claim 16 further comprising a piecing device mounting the transport roller for movement between an attending position and an operative position.

22. The apparatus as defined in claim 21 wherein the transport roller in its operative position, the yarn heater, and the cooling plate are mounted successively in a generally linear arrangement and so as to define a generally straight yarn path therealong.

23. The apparatus as defined in claim 16 wherein said second yarn delivery mechanism comprises a second transport roller about which the yarn is at least partially wrapped and a second drive for controlling the rotation of the second transport roller and wherein said drive control controls the second drive of the second yarn delivery mechanism independently of the second drives of the second yarn delivery mechanisms of adjacent yarn processing stations.

24. The apparatus as defined in claim 23 wherein the drive for the transport roller of the first yarn delivery mechanism and the second drive for the second transport roller of the second yarn delivery mechanism are each connected to a control device for independently controlling the same.

25. The apparatus as defined in claim 24 wherein the control device of each yarn processing station is connected to a common machine control unit.

26. The apparatus as defined in claim 23 wherein each yarn processing station further comprises a second elongate heater downstream of the second yarn delivery mechanism, and a third yarn delivery mechanism located downstream of the second elongate heater.

27. The apparatus as defined in claim 26 wherein each yarn processing station further comprises a further yarn delivery mechanism disposed between the second yarn delivery mechanism and the second elongate heater.

28. A yarn false twist texturing apparatus comprising a winding frame mounting a plurality of winding devices one above the other, a creel frame disposed on one side of the winding frame and mounting a plurality of supply bobbins one above the other, a processing frame disposed on the side of the winding frame which is opposite the creel frame, false twist imparting means for imparting twist to an advancing yarn and comprising an elongate yarn heater, an elongate cooling plate, and a false twist unit, a first yarn delivery mechanism for withdrawing a yarn from one of the bobbins in the creel frame, and including a rotatable transport roller and a drive for controlling the rotation of the roller, a second yarn delivery mechanism for advancing the yarn from the first yarn delivery mechanism serially along the yarn heater, along the cooling plate, and then through the false twist unit, a piecing device mounting the transport roller for movement between an attending position and an operative position, and wherein the transport roller in its operative position, the elongate yarn heater, and the elongate cooling plate are all located at an elevation generally above said winding frame, said creel frame, and said processing frame, and are disposed successively in a generally linear arrangement and so as to define a generally straight yarn path therealong.

29. The apparatus as defined in claim 28 wherein the processing frame is spaced from said winding frame to define an attending aisle therebetween, and wherein the attending position of said piecing device is accessible from the attending aisle.

30. The apparatus as defined in claim 29 wherein the operative position of the transport roller is disposed above the side of the winding frame opposite the attending aisle.

31. The apparatus as defined in claim 30 wherein the creel frame is spaced from the winding frame so as to form a doffing aisle therebetween.

32. The apparatus as defined in claim 28 wherein the drive is mounted to the piecing device for movement with the transport roller.

33. The apparatus as defined in claim 28 further comprising a yarn cutter mounted upstream of the first yarn delivery mechanism.

34. The apparatus as defined in claim 28 further comprising a second heater positioned downstream of the second yarn delivery mechanism, and a third yarn delivery mechanism for advancing the yarn from the second heater to an associated winding device.

35. The apparatus as defined in claim 34 wherein the second yarn delivery mechanism and the second heater are mounted on the processing frame, and the third yarn delivery mechanism is mounted on the winding frame.

36. A method of false twist texturing a synthetic yarn comprising the steps of advancing the yarn from a supply bobbin through a false twisting zone which includes an elongate heater, an elongate cooling plate, and a false twist unit, and such that a false twist backs up to a twist stopping device located within the false twisting zone and which comprises a rotatable roller located upstream of the elongate heater, and controlling the tension of the yarn as it advances through the false twisting zone by adjusting the rotational speed of the roller so that the yarn tension remains substantially constant.

37. The method as defined in claim 36 comprising the further step of withdrawing the advancing yarn from the false twisting zone by means of a delivery mechanism and guiding the yarn from the delivery mechanism to a winding device where the yarn is wound into a package.

38. A method of threading a yarn into a false twist texturing machine which comprises a first yarn delivery mechanism for withdrawing a yarn from a supply bobbin, an elongate yarn heater, an elongate cooling plate, a false twist unit, and a second yarn delivery mechanism for advancing the yarn from the first yarn delivery mechanism serially along the yarn heater, along the cooling plate, and through the false twist unit, and comprising the steps of controlling the first and second yarn delivery mechanisms so as to operate at a piecing speed, and threading a yarn from the supply bobbin through the machine, and then controlling the first and second yarn delivery mechanisms so as to operate at an operating speed which is greater than the piecing speed.

39. The method as defined in claim 38 wherein the piecing speed is the same for the first and second delivery mechanisms.

40. The method as defined in claim 39 wherein the switchover from the piecing speed to the operating speed is effected in accordance with a preselected timing function.

41. The method as defined in claim 39 comprising the further step of establishing a draw ratio between the first and second yarn delivery mechanisms after the attainment of the operating speed.

* * * * *

UNITED STATES PATENT AND TRADEMARK OFFICE

CERTIFICATE OF CORRECTION

PATENT NO. : 6,209,302 B1
DATED : April 3, 2001
INVENTOR(S) : Wortmann et al.

It is certified that error appears in the above-identified patent and that said Letters Patent is hereby corrected as shown below:

Title page, Item [54], and Column 1, line 1,
In the title, "TEXTURIZING" should read -- TEXTURING --.

Item [30],
Foreign Application Priority Data, insert the following:
-- Feb. 15, 1997 (DE) 197 05 811 --.

Column 19,
Lines 3 and 4, "drive drive 59", both occurrences, should read -- drive unit 59 --.

Signed and Sealed this

Twentieth Day of November, 2001

*Attest:*

Nicholas P. Godici

NICHOLAS P. GODICI
*Acting Director of the United States Patent and Trademark Office*

*Attesting Officer*